US011772923B2

(12) United States Patent
Natori et al.

(10) Patent No.: US 11,772,923 B2
(45) Date of Patent: Oct. 3, 2023

(54) SHEET FEEDING APPARATUS

(71) Applicants: Jun Natori, Yamanashi (JP); Akiharu Higaki, Yamanashi (JP); Takuya Sakamoto, Yamanashi (JP); Naoki Yokoyama, Yamanashi (JP); Kazunori Hatakawa, Yamanashi (JP); Naoto Takeshita, Yamanashi (JP); Hiroshi Yazawa, Yamanashi (JP); Noritoshi Aikawa, Yamanashi (JP); Masatoshi Ozawa, Yamanashi (JP); Makoto Ozawa, Yamanashi (JP)

(72) Inventors: Jun Natori, Yamanashi (JP); Akiharu Higaki, Yamanashi (JP); Takuya Sakamoto, Yamanashi (JP); Naoki Yokoyama, Yamanashi (JP); Kazunori Hatakawa, Yamanashi (JP); Naoto Takeshita, Yamanashi (JP); Hiroshi Yazawa, Yamanashi (JP); Noritoshi Aikawa, Yamanashi (JP); Masatoshi Ozawa, Yamanashi (JP); Makoto Ozawa, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/552,821

(22) Filed: Dec. 16, 2021

(65) Prior Publication Data

US 2022/0204293 A1 Jun. 30, 2022

(30) Foreign Application Priority Data

Dec. 24, 2020 (JP) ..... 2020-214560
Dec. 24, 2020 (JP) ..... 2020-214562
Feb. 26, 2021 (JP) ..... 2021-029481

(51) Int. Cl.
*B65H 29/62* (2006.01)
*B65H 43/04* (2006.01)
*B65H 7/12* (2006.01)

(52) U.S. Cl.
CPC ..... *B65H 7/12* (2013.01); *B65H 29/62* (2013.01); *B65H 2405/10* (2013.01); *B65H 2553/00* (2013.01)

(58) Field of Classification Search
CPC ..... B65H 7/12; B65H 7/125; B65H 29/62; B65H 29/60; B65H 2511/13;
(Continued)

(56) References Cited

U.S. PATENT DOCUMENTS 4,012,032 A * 3/1977 Rogers ..... G03G 15/6552 271/259
2003/0170059 A1* 9/2003 Koga ..... B65H 1/04 399/388

(Continued)

FOREIGN PATENT DOCUMENTS

JP 2007-279168 A 10/2007
JP 2008-180900 A 8/2008

(Continued)

*Primary Examiner* — Luis A Gonzalez
(74) *Attorney, Agent, or Firm* — Manabu Kanesaka

(57) ABSTRACT

A sheet feeding apparatus for feeding sheets is provided with a multi feed detecting section for detecting multi feed of conveyed sheets in a predetermined detection position of a conveyance path, and first and second discharge sections to which multi-fed sheets with the multi feed detected are discharged, and corresponding to one of a front end position of the multi-fed sheets at the time the multi feed detecting section detects the multi feed of sheets, a sheet storage state of the second discharge section, sheet storage states of the first and second discharge sections, a size of sheets and weighing, selects one of the first and second discharge
(Continued)

sections to discharge the multi-fed sheets to the selected discharge section.

8 Claims, 21 Drawing Sheets

(58) Field of Classification Search
CPC . B65H 2511/11; B65H 2511/10; B65H 43/04; B65H 43/06; B65H 43/08; B65H 31/24; B65H 2511/524; B65H 2511/528; B65H 2601/11; G03G 2215/00548
See application file for complete search history.

(56) References Cited

U.S. PATENT DOCUMENTS

| | | | | |
|---|---|---|---|---|
| 2009/0218747 | A1* | 9/2009 | Mutsuno | B65H 7/06 271/9.01 |
| 2014/0027971 | A1* | 1/2014 | Fu | B65H 7/12 271/18 |
| 2022/0135362 | A1* | 5/2022 | Ariga | B65H 7/125 270/58.03 |

FOREIGN PATENT DOCUMENTS

| | | | | |
|---|---|---|---|---|
| JP | 2011-042469 | A | | 3/2011 |
| JP | 2011-095367 | A | | 5/2011 |
| JP | 2017072782 | A | * | 4/2017 |
| JP | 2018-199565 | A | | 12/2018 |
| JP | 2019156584 | A | * | 9/2019 |

* cited by examiner

N1≧N2

N1<N2

SHEET FEEDING APPARATUS

BACKGROUND OF THE INVENTION

1. Field of the Invention

The present invention relates to a sheet feeding apparatus for discharging multi-fed sheets occurring in a conveyance path to a predetermined discharge section.

2. Description of Related Arts

Conventionally, in image forming apparatuses such as a copier, there have been cases of connecting a sheet feeding apparatus provided with a plurality of sheet feeding units to feed a large number of sheets continuously, and of coupling a plurality of sheet feeding apparatuses to use. Thus, by being provided with a plurality of sheet feeding units or sheet feeding apparatuses, it is possible to perform image formation on the higher number of sheets continuously, without halting the image forming apparatus. Further, since it is possible to store various types of sheets different in size and quality, there are merits such that efforts are eliminated to change sheets and the like.

In sheet feeding apparatuses provided with a plurality of sheet feeding units to feed sheets to an image forming unit, there is an apparatus which is provided with an escape section to discharge failed sheets such as multi-fed sheets without conveying to the image forming apparatus, and which is thereby capable of continuing sheet feeding operation for normally fed sheets, without halting the entire apparatus.

In the above-mentioned sheet feeding apparatus, the escape section is provided in a sheet feed path between the image forming apparatus and a downstream-side sheet feeding unit among a plurality of sheet feeding units, and it is configured to discharge, to the escape section, failed sheets due to multi feed and the like in the plurality of sheet feeding units. Also in such a sheet feeding unit provided with the escape section, when the escape section is full of sheets, in order to remove the sheets of the full escape section, it is necessary to halt the apparatus. Further, when there is a sheet which is not capable of being discharged to the escape section and halts in the sheet feed path, unless the sheet is removed, it is not possible to restart the apparatus. Thus, as the frequency with which the escape section is full increases, productivity decreases, and there is a problem that operation for removing failed sheets occurs frequently.

SUMMARY OF THE INVENTION

A sheet feeding apparatus for feeding sheets is provided with a multi feed detecting section for detecting multi feed of conveyed sheets in a predetermined detection position of a conveyance path, and first and second discharge sections (escape sections) to which multi-fed sheet with the multi feed detected are discharged, and corresponding to one of a front end position of the multi-fed sheets at the time the multi feed detecting section detects the multi feed of sheets, a sheet storage state of the second discharge section, sheet storage states of the first and second discharge sections, a size of sheets and weighing, selects one of the first and second discharge sections to discharge the multi-fed sheets to the selected discharge section.

DETAILED DESCRIPTION OF THE PREFERRED EMBODIMENT

[Image Forming System]

Figure 1:
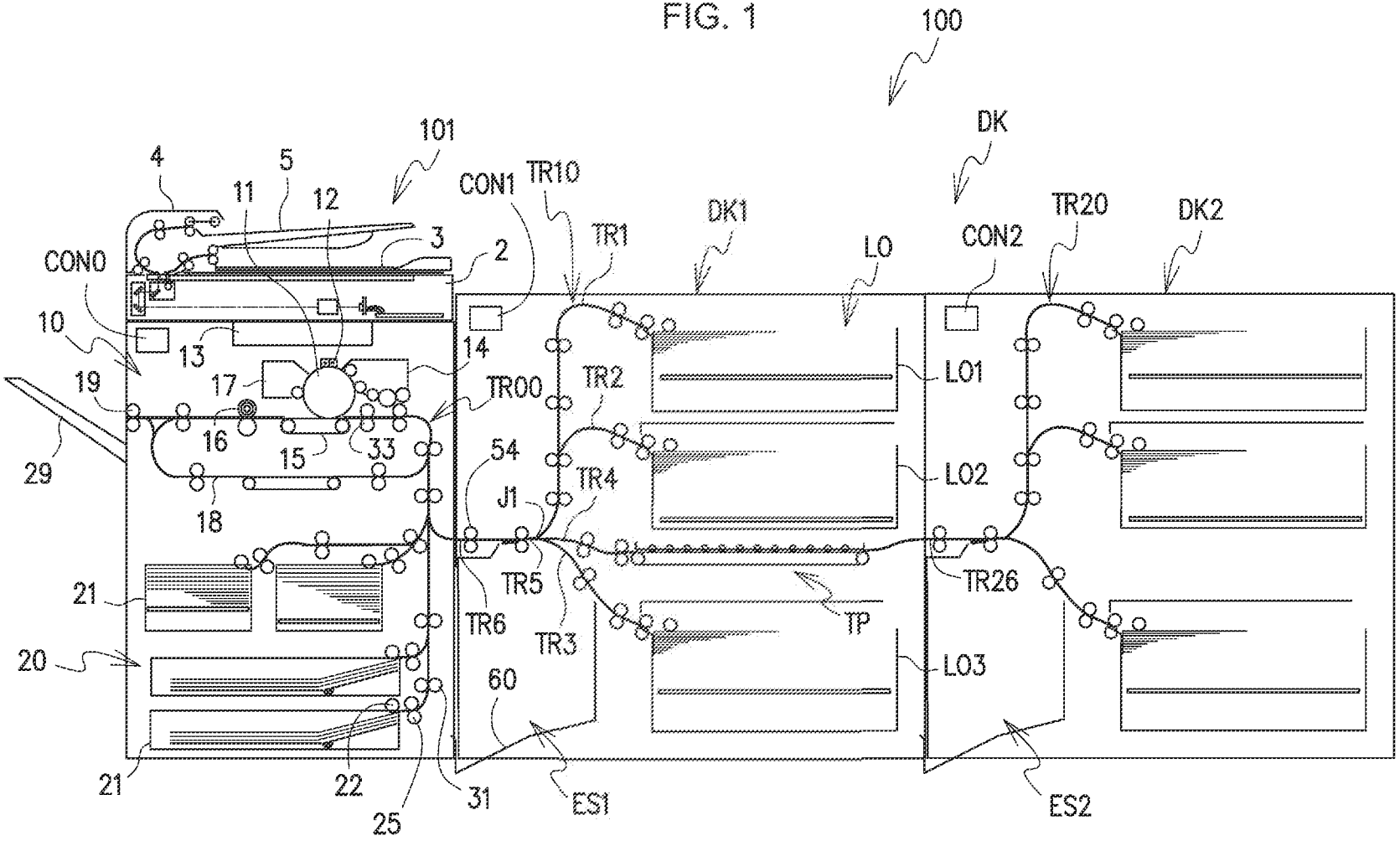
FIG. 1 is a configuration view illustrating an image forming system provided with a sheet feeding apparatus according to the present invention.

Embodiments of the present invention will be described below in detail with reference to accompanying drawings. FIG. 1 illustrates the entire configuration of an image forming system 100 provided with an image forming apparatus 101, and a sheet feeding apparatus DK capable of being coupled to the image forming apparatus 101. In this Embodiment, the sheet feeding apparatus DK is a two-stage configuration comprised of a downstream-side sheet feeding unit (first sheet feeding unit) DK1 and an upstream-side sheet feeding unit (second sheet feeding unit) DK2, but may a configuration where a plurality of independent sheet feeding units is coupled, and the number of stages of the sheet feeding unit is not limited. In the following description, a laser printer system using an electrophotographic scheme will be described, as one example of the image forming apparatus 101. In addition, as well as the printer, the image forming apparatus 101 may be a copier, facsimile, composite machine and the like, and may be another scheme such as an ink jet scheme, without being limited to the electrophotographic scheme.

Each of the first sheet feeding unit DK1 and second sheet feeding unit DK2 is provided with a plurality of storage sections (storage chambers) each capable of storing a plurality of sheets, and is capable of feeding sheets toward the image forming apparatus 101 from each storage chamber. In addition, as types of sheets, it is possible to use normal sheets, thin sheets, thick sheets, plastic sheets and the like.

Figure 2:
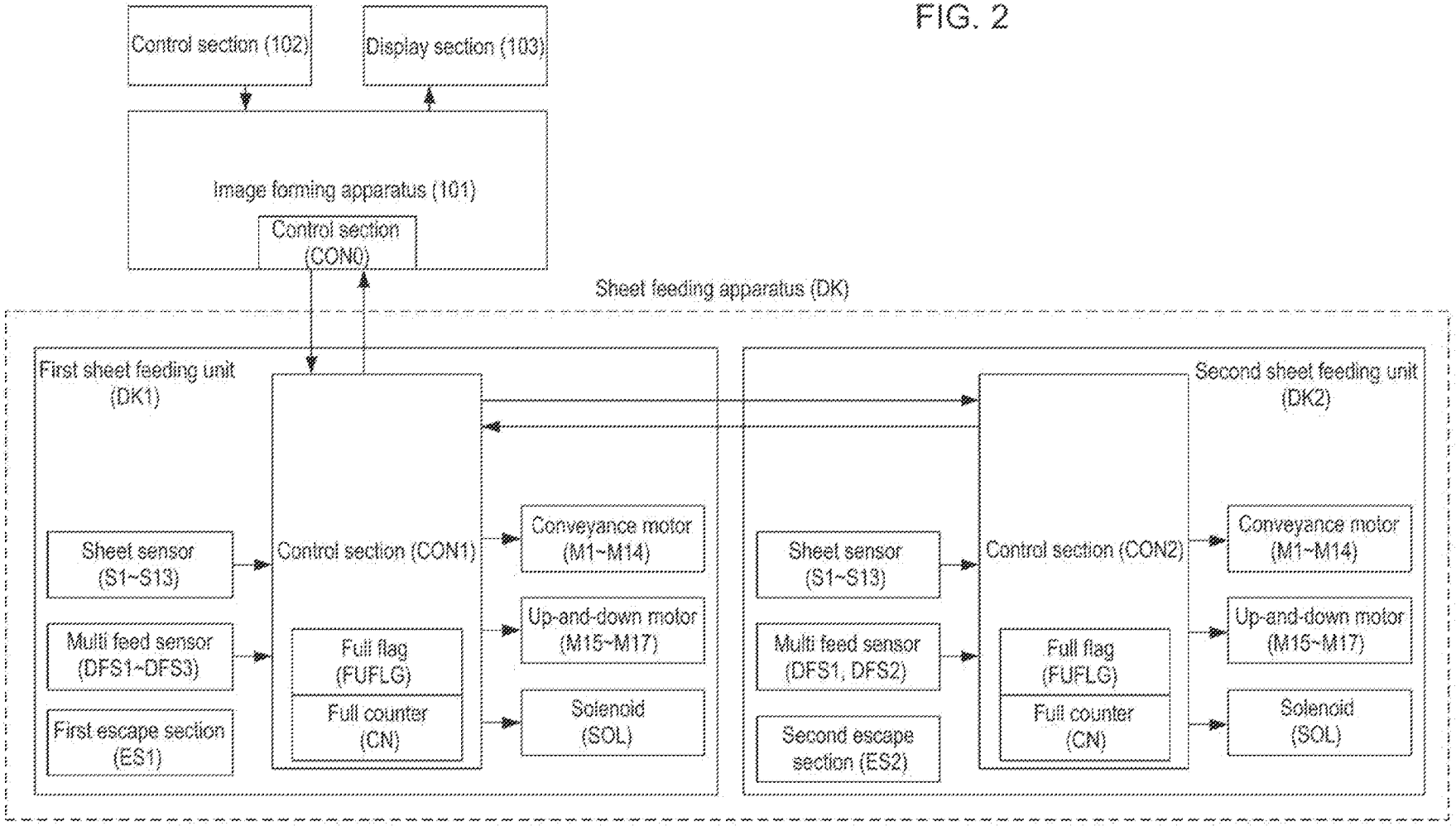
FIG. 2 is a block diagram illustrating a control configuration of the image forming system provided with the sheet feeding apparatus according to the present invention.

FIG. 2 is a block diagram illustrating control configurations of the image forming apparatus 101 and the sheet feeding apparatus DK and mutual connection relationship therebetween in the image forming system 100. The image forming apparatus 101 is provided with a control section CON0 for controlling execution of conveyance of sheets and image forming processing, operation section 102 and broadcast section (display section) 103. Each of the first sheet feeding unit DK1 and second sheet feeding unit DK2 constituting the sheet feeding apparatus DK is provided with a control section (CON1, CON2) for controlling conveyance feeding of sheets, conveyance position detecting sections (sheet sensors) S1 to S13 disposed in predetermined positions of conveyance paths to detect a front end of a sheet under conveyance, multi feed detecting sections (multi feed sensors) DFS1 to DFS3 for detecting the presence or absence of multi feed of sheets, conveyance motors M1 to M14, up-and-down motors M15 to M17, solenoid SOL and the like. Inside the sheet feeding apparatus DK, the control section CON1 of the first sheet feeding unit DK1 and the control section CON2 of the second sheet feeding unit DK2 are electrically connected to each other. Further, the sheet feeding apparatus DK and image forming apparatus 101 are electrically connected to each other via the control section CON1 of the first sheet feeding unit DK1 and the control section CON0 of the image forming apparatus 101.

As shown in FIG. 1, the image forming apparatus 101 conveys, to an image forming section 10, various types of sheets fed from a sheet feeding section 20 (a plurality of sheet feeding cassettes 21) provided inside and a plurality of storage chambers inside the sheet feeding apparatus DK (first sheet feeding unit DK1, second sheet feeding unit DK2) separated in a sheet-by-sheet state. Then, after forming an image on the sheet in the image forming section 10, the sheet is discharged from a discharge tray 29.

The first sheet feeding unit DK1 is provided with a through pass section TP to relay and convey sheets fed from the second sheet feeding unit DK2 to the image forming apparatus 101.

The operation section 102 selects sheets fed to the image forming section 10 from among the sheet feeding section 20, the first sheet feeding unit DK1 and the second sheet feeding unit DK2, and designates a printing method, the number of copies to print and the like. Further, the display section 103 displays the section or the storage chamber from which the sheet is fed among the sheet feeding section 20, and respective storage chambers of the first sheet feeding unit DK1 and the second sheet feeding unit DK2, and whether or not sheets are multi-fed. In addition, without directly operating the operation section 102, it is also possible to remotely control from an information terminal device such as a PC and smart phone outside the apparatus.

An image reading apparatus 2 provided in the image forming apparatus 101 irradiates a document placed on platen 3 with light by a scanning optical system light source, while inputting reflected light to a CCD, and thereby reads a document image. Further, the image reading apparatus 2 is capable of being connected to an automatic document feeder (ADF) 4, and is also able to read a document image by automatically conveying a document set on a tray 5 to a reading section of the image reading apparatus 2. Then, the read document image is converted into an electric signal, and is transmitted to a laser scanner 13 of the image forming section 10 described later. There is also the case where image data transmitted from the outside terminal device and the like is input to the laser scanner 13.

The sheet feeding section 20 is provided with a plurality of sheet feeding cassettes 21 for storing various types of sheets, a pickup roller 22, a separation conveyance roller pair 25, and the like. The sheets stored inside the sheet feeding cassette 21 are separated on a sheet-by-sheet basis, by the pickup roller 22 for performing up-and-down operation and rotating at predetermined timing, and the separation conveyance roller pair 25.

A conveyance path TR00 of the image forming apparatus 101 is provided with a conveyance roller pair 31 and register roller pair 33. A sheet guided from the conveyance roller pair 31 to the register roller pair 33 is fed to the image forming section 10 at predetermined timing. Further, a sheet fed from the sheet feeding apparatus DK merges with the conveyance path TR00 of the image forming apparatus 101 via a conveyance roller pair 54 and connection path TR6 provided in the first sheet feeding unit DK1.

The image forming section 10 is provided with a photosensitive drum 11, a charging device 12, the laser scanner 13, a developing device 14, a transfer device 15, a cleaner 17 and the like. At the time of image formation, the photosensitive drum 11 is driven to rotate, and first, a surface of the photosensitive drum 11 is uniformly charged by the charging device 12. Then, the charged photosensitive drum 11 is irradiated with laser light from the laser scanner 13 emitted corresponding to the image signal, and an electrostatic latent image is thereby formed on the photosensitive drum 11. Further, the electrostatic latent image thus formed on the photosensitive drum 11 is developed as a toner image by the developing device 14.

Subsequently, the toner image on the photosensitive drum 11 is transferred to the sheet by the transfer device 15. Further, the sheet with the toner image transferred is conveyed to a fuser device 16 to fuse the toner image, and subsequently, is discharged to a discharge tray 29 via a discharge roller pair 19.

In the case of forming a toner image on the backside of the sheet, the sheet discharged from the fuser device 16 is conveyed to a switchback path 18. Then, in a state in which the side is reversed by the switchback path 18, the sheet is conveyed again to the transfer device 15 of the image forming section 10. The sheet with the toner image transferred to the backside is conveyed to the fuser device 16, and after fusing the toner image, is discharged to the discharge tray 29 by the discharge roller pair 19. In addition, after transferring, transfer residual toner left on the photosensitive drum 11 is removed by the cleaner 17.

The control section CON0 has a CPU, ROM and RAM. The CPU reads programs that correspond to control procedures stored in the ROM to control each section. Further, in the RAM is stored operation data and input data, and the CPU performs control by referring to the data stored in the RAM, based on the programs and the like.

The operation section 102 provided in the image forming apparatus 101 sets image formation conditions, for example, such as sheet size designation and color monochrome printing designation, and printing conditions such as number-of-printed copies designation, one-sided two-sided printing designation and scaling printing designation.

[Sheet Feeding Apparatus]

Figure 3:
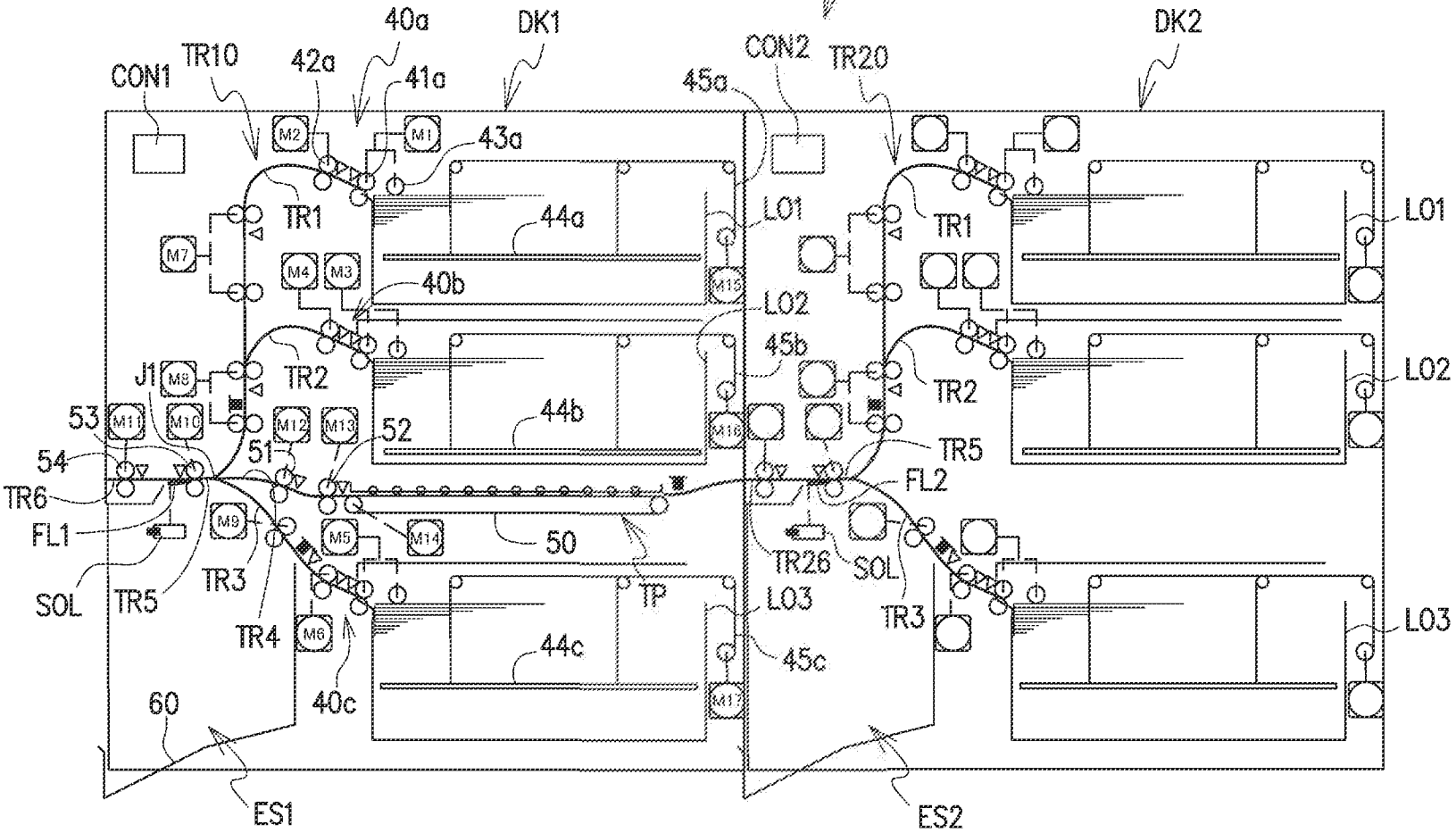
FIG. 3 is a configuration view illustrating a configuration of the sheet feeding apparatus according to the present invention.
Figure 4:
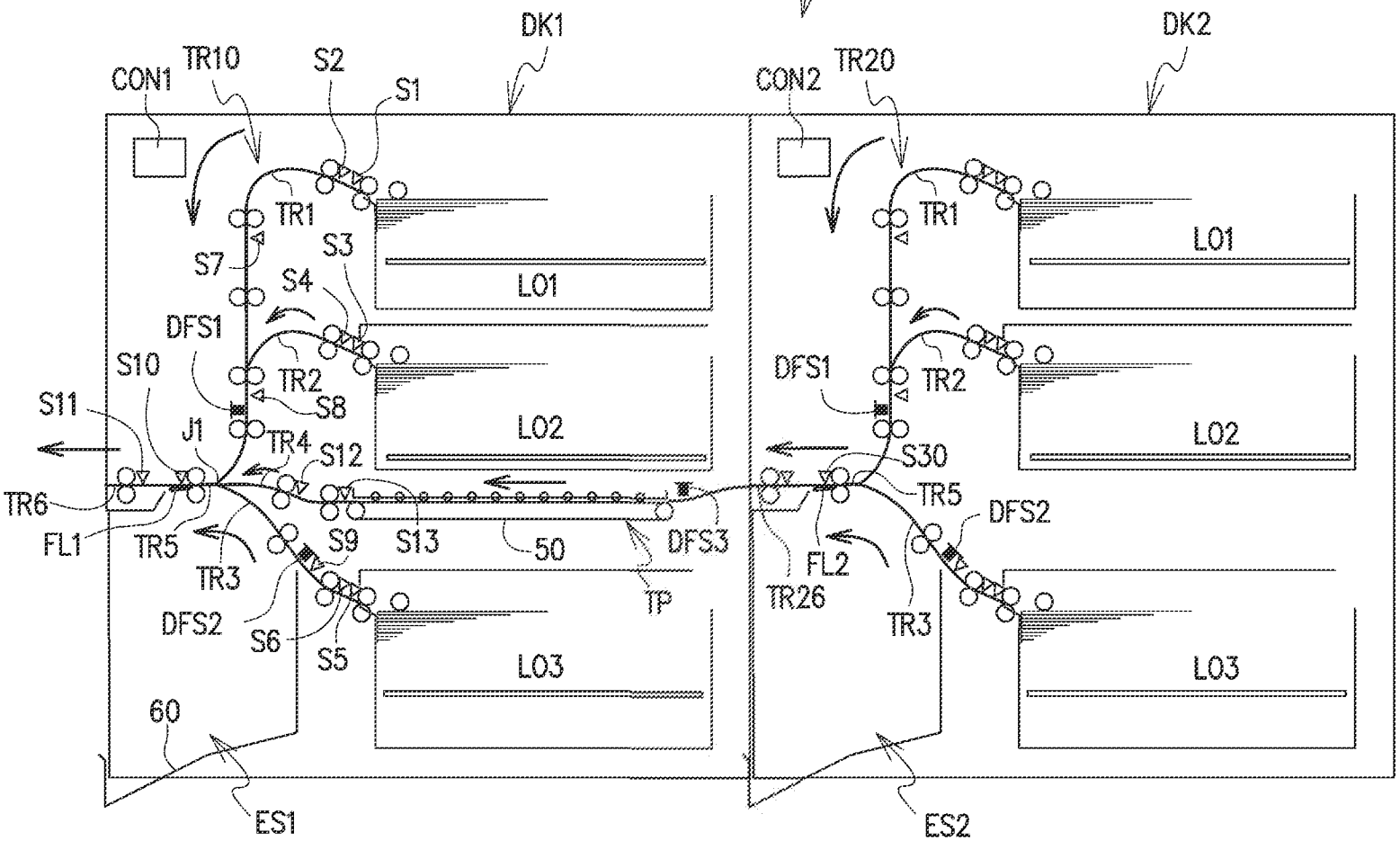
FIG. 4 is another configuration view illustrating the configuration of the sheet feeding apparatus according to the present invention.

Details of the sheet feeding apparatus DK will be described next. FIGS. 3 and 4 are configuration views illustrating the configuration of the sheet feeding apparatus DK. As shown in FIGS. 3 and 4, the first sheet feeding unit DK1 and second sheet feeding unit DK2 are the same configuration except the through pass section TP, and therefore, only the first sheet feeding unit DK1 will be described herein.

The first sheet feeding unit DK1 is provided with a plurality of storage chambers LO1 to LO3, a first conveyance path TR10 comprised of a plurality of conveyance paths TR1 to TR5 extending from the upstream side to the downstream side, a plurality of conveyance roller pairs disposed in respective conveyance paths, sheet sensors S1 to S13, multi feed sensors DFS1 to DFS3, motors M1 to M17, through pass section TP and the like. In this Embodiment, three storage chambers LO1 to LO3 are disposed in three stages vertically, and the through pass section TP is provided between the third storage chamber LO3 in a lower stage and the second storage chamber LO2 in a middle stage. In addition, the second sheet feeding unit DK2 is not provided with the through pass section TP and multi feed sensor DFS3.

The sheet fed from the first storage chamber LO1 in an upper stage is conveyed to the conveyance path TR1, the sheet fed from the second storage chamber LO2 in the middle stage is conveyed to the conveyance path TR2 merging with the conveyance path TR1, and the sheet fed from the third storage chamber LO3 in the lower stage is conveyed to the conveyance path TR3. The sheet conveyed from the second sheet feeding unit DK2 via the through pass section TP is conveyed to the conveyance path TR4. Further, the conveyance paths TR1, TR3 and TR4 merge at a joint point J1, and the sheet is conveyed by the conveyance roller pair 54 though the conveyance path TR5, and merges with the conveyance path TR00 of the image forming section 10 inside the image forming apparatus 101 via the connection path TR6.

Further, as shown in FIG. 4, the multi feed sensors DFS1 to DFS3 for detecting multi feed of sheets are disposed in the conveyance path TR1 merged with the conveyance path TR2, conveyance path TR3 and through pass section TP, respectively. Then, sheets (hereinafter, referred to as multi-fed sheets) with the multi feed detected by the multi feed sensors DFS1 to DFS3 are conveyed to the conveyance path TR5. Below the conveyance path TR5 is provided a discharge section (first escape section) ES1 on the downstream side to discharge the multi-fed sheets. The multi-fed sheets are discharged to the first escape section ES1, by switching the path by a switch member (flapper) FL1 provided in a guide section provided in the conveyance path TR5. Details of processing in the case where multi feed is detected will be described later.

Sheets fed from the storage chambers LO1 to LO3 are conveyed to the connection path TR6 via the conveyance paths TR1, TR3 and TR4. Further, in the first sheet feeding unit DK1, the control section CON1 controls each section. The control section CON1 has a CPU, ROM and RAM. The control section CON1 is capable of communicating with the control section CON0 of the image forming apparatus 101, and by communicating with the control section CON0, controls feed timing of sheets and the like.

As shown in FIG. 3, the first storage chamber LO1 has a sheet feeding section 40*a* for feeding the sheet toward the image forming apparatus 101, and a stack tray 44*a* for stacking a plurality of sheets. The stack tray 44*a* is capable of moving up and down vertically by an up-and-down mechanism 45*a* driven by the up-and-down motor M15. The stack tray 44*a* moves down to a predetermined position in stacking sheets, and moves up gradually as the stacked sheets are fed.

The sheet feeding section 40*a* is provided with a first sheet conveying section comprised of a pickup roller 43*a*, a separation conveyance roller pair 41*a* comprised of a conveyance roller and retard roller, a conveyance roller pair 42*a* and the like. The pickup roller 43*a* and separation conveyance roller pair 41*a* are driven to rotate by the conveyance motor M1, and the conveyance roller pair 42*a* is driven to rotate by the conveyance motor M2. Further, in the sheet feeding section 40*a* are disposed the sheet sensor S1 for detecting the front end of the sheet on the downstream side of the separation conveyance roller pair 41*a* in a conveyance direction, and the sheet sensor S2 for detecting the front end of the sheet on the upstream side of the conveyance roller pair 42*a* in the conveyance direction.

The pickup roller 43*a* is provided above the stack tray 44*a*, and comes into contact with the uppermost sheet of sheets stacked on the raised stack tray 44*a* to feed. Therefore, the pickup roller 43*a* is disposed so as to come into press-contact with the uppermost sheet on the stack tray 44*a* by appropriate force in the vicinity of the front end of the sheet in the sheet conveyance direction. Then, by rotating, the roller feeds out the uppermost sheet.

The separation conveyance roller pair 41*a* separates to convey only a single sheet, in the case where two or more sheets are fed from the pickup roller 43*a*, while overlapping, in other words, in the case where two or more sheets are multi-fed.

The sheet which is separated and fed by the separation conveyance roller pair 41*a* is conveyed to the conveyance path TR1 by the conveyance roller pair 42*a*. In the conveyance path TR1 is disposed a plurality of conveyance roller pairs driven to rotate by the conveyance motors M7 and M8. Further, as shown in FIG. 4, in the conveyance path TR1 are disposed the sheet sensor S7 for detecting the front end of the sheet on the upstream side in the conveyance direction, and the sheet sensor S8 for detecting the front end of the sheet on the downstream side in the conveyance direction.

The second and third storage chambers LO2, LO3 have sheet feeding sections 40*b*, 40*c* for feeding the sheet toward the image forming apparatus 101, stack trays 44*b*, 44*c* for stacking a plurality of sheets, and up-and-down mechanisms 45*b*, 45*c*. In addition, configurations of the sheet feeding sections 40*b*, 40*c* and conveyance motors M3 to M6 are the same as in the sheet feeding section 40*a*, and further, configurations of the up-and-down mechanisms 45*b*, 45*c* and up-and-down motors M16, M17 are the same as in the up-and-down mechanism 45*a*. Therefore, descriptions thereof are omitted.

In the through pass section TP, the sheet is conveyed inside the apparatus by a conveyor 50 driven to rotate by the conveyance motor M14. Further, in the through pass section TP, on the upstream side from the conveyor 50 in the conveyance direction is disposed the multi feed sensor DFS3 for detecting whether or not two or more sheets are multi-fed to the through pass section TP.

The sheet conveyed by the conveyor 50 is conveyed inside the conveyance path TR4 by a conveyance roller pair 51 driven to rotate by the conveyance motor M12 and a conveyance roller pair 52 driven to rotate by the conveyance motor M13.

In the conveyance path TR4 are disposed the sheet sensor S12 for detecting the front end of the sheet on the upstream side of the conveyance roller pair 51 in the conveyance direction, and the sheet sensor S13 for detecting the front end of the sheet on the upstream side of the conveyance roller pair 52 in the conveyance direction.

The conveyance paths TR1, TR3 and TR4 merge at the joint point J1, and are connected to the conveyance path TR5. In the conveyance path TR5 are disposed a conveyance roller pair 53 driven to rotate by the conveyance motor M10, and the conveyance roller pair 54 driven to rotate by the conveyance motor M11, and the sheet fed out by the conveyance roller pair 54 is conveyed to the image forming apparatus 101 via the connection path TR6.

Further, in the conveyance path TR5 are disposed the sheet sensor S10 for detecting the front end of the sheet in the vicinity of the downstream side of the conveyance roller pair 53, and the sheet sensor S11 for detecting the front end of the sheet in the vicinity of the upstream side of the conveyance roller pair 54. A flapper FL1 is disposed in the conveyance path TR5. The flapper FL1 is provided in a branch position DP for blocking the connection path TR6 connecting to the image forming apparatus 101 to open the first escape section ES1, and is switched between a position for blocking the connection path TR6 and an opening position for opening the first escape section ES1 by ON/OFF of the solenoid SOL.

The first escape section ES1 is provided below the joint point J1 of the conveyance paths TR3, TR5 to convey the sheet from the third storage chamber LO3 to the image forming apparatus 101 and the conveyance paths TR1, TR2, TR3 below the connection path TR6. As shown in FIG. 3, in the first escape section ES1, a discharge region of multi-fed sheets in the conveyance direction of the sheet conveyed in the conveyance paths TR3, TR5 is a wide range from a position adjacent to the image forming apparatus 101 to a position adjacent to the storage chamber LO3. In other words, in the first escape section ES1, a length in the conveyance direction of the sheet passing the conveyance paths TR3, TR5 is a length from the conveyance path TR3 to the connection path TR6 via the joint point J1 and flapper FL1. Further, in its height direction, the first escape section ES1 is provided with a discharge region of multi-fed sheets from a position of the conveyance path TR3 i.e. a position of the flapper FL1 to a position lower than a bottom 61 of the first sheet feeding unit DK1.

The second sheet feeding unit DK2 is provided with a plurality of storage chambers LO1 to LO3, a second conveyance path TR20 comprised of a plurality of conveyance paths TR1 to TR5 extending from the upstream side to the downstream side, a second sheet conveying section comprised of a plurality of conveyance roller pairs disposed in respective conveyance paths, sheet sensors S1 to S13, multi feed sensors DFS1, DFS2, motors M1 to M17 and the like. The second conveyance path TR20 merges with the first conveyance path TR10 via a connection path TR26 on the downstream side. In addition, configurations and arrangements of the first to third storage chambers LO1 to LO3, a plurality of conveyance roller pairs disposed in respective conveyance paths, a plurality of sheet sensors S1 to S13, a plurality of multi feed sensors DFS1, DFS2, a plurality of motors M1 to M17 and the like are common to the first sheet feeding unit DK1.

Embodiment 1 of multi feed processing according to the present invention will be described next. In Embodiment 1, corresponding to a position of sheets when the multi feed sensors DFS1, DFS2 of the second sheet feeding unit DK2 detect multi feed, the multi-fed sheets are conveyed to one of the first escape section ES1 and second escape section ES2.

The description will be given specifically. Embodiment 1 is provided with first multi feed processing corresponding to the multi feed sensors DFS1 to DFS3 of the first sheet feeding unit DK1, and second multi feed processing corresponding to the multi feed sensors DFS1, DFS2 of the second sheet feeding unit DK2 coupled to the first sheet feeding unit DK1. The first multi feed processing and second multi feed processing is performed by the control sections CON1, CON2 provided in the first and second sheet feeding units DK1, DK2.

Figure 5A:
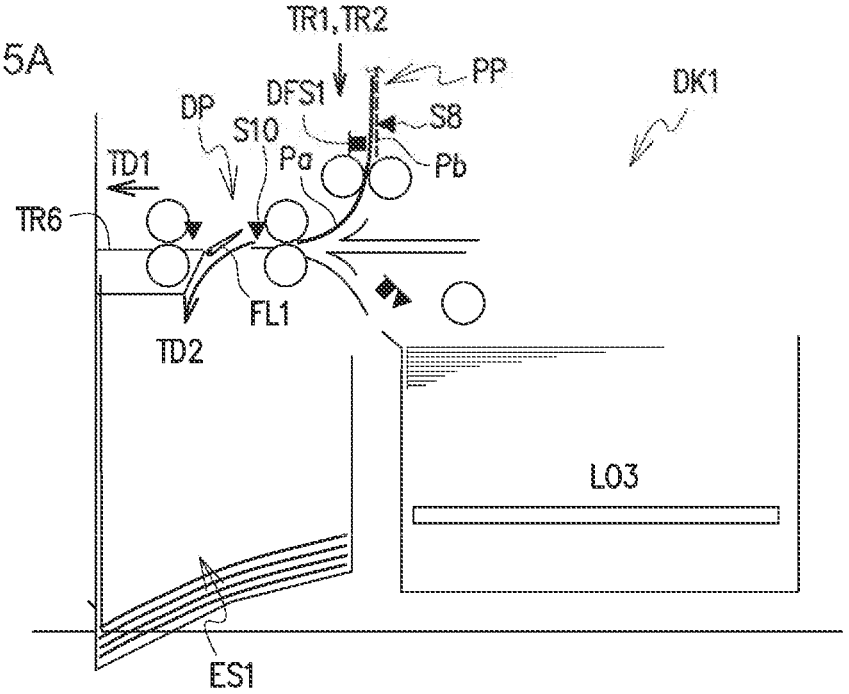
FIGS. 5A and 5B contain state views illustrating first multi feed processing in the sheet feeding apparatus according to the present invention.
Figure 5B:
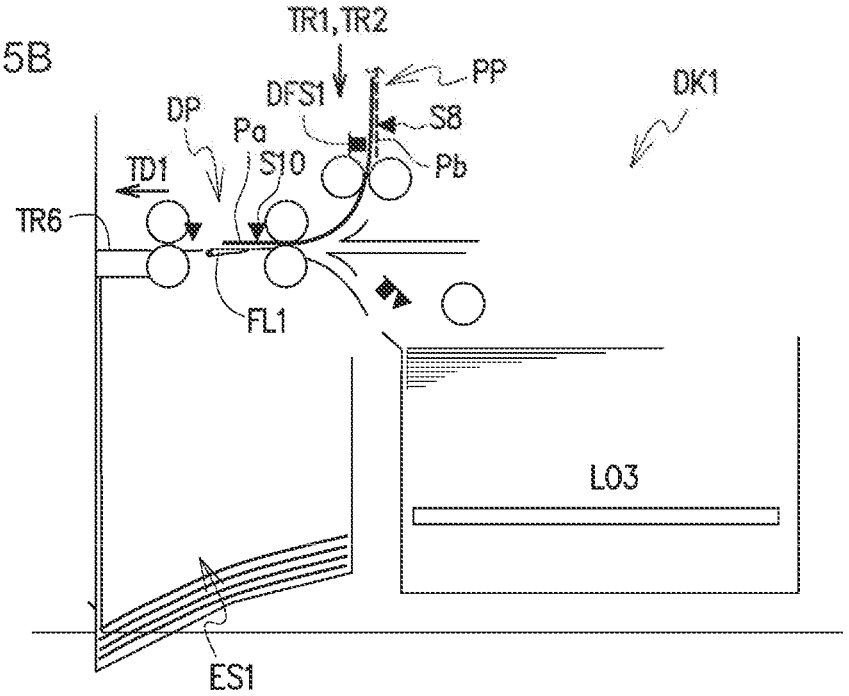
Figure 6A:
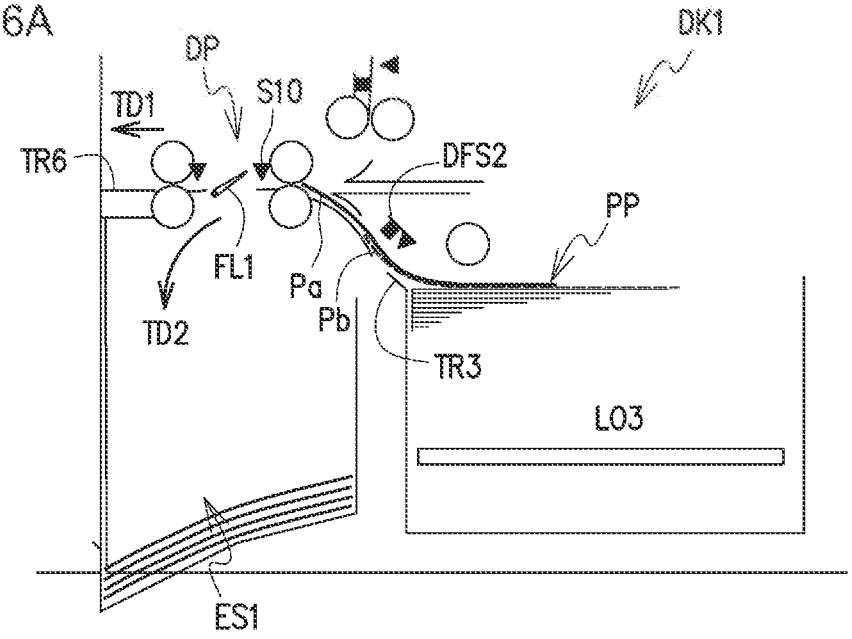
FIGS. 6A and 6B contain state views illustrating the first multi feed processing in the sheet feeding apparatus according to the present invention.
Figure 6B:
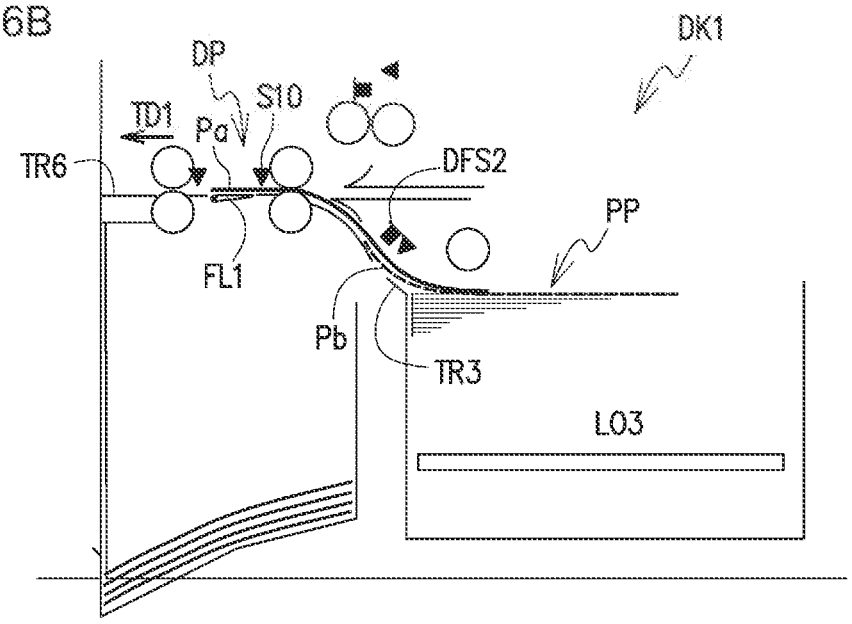
Figure 7:
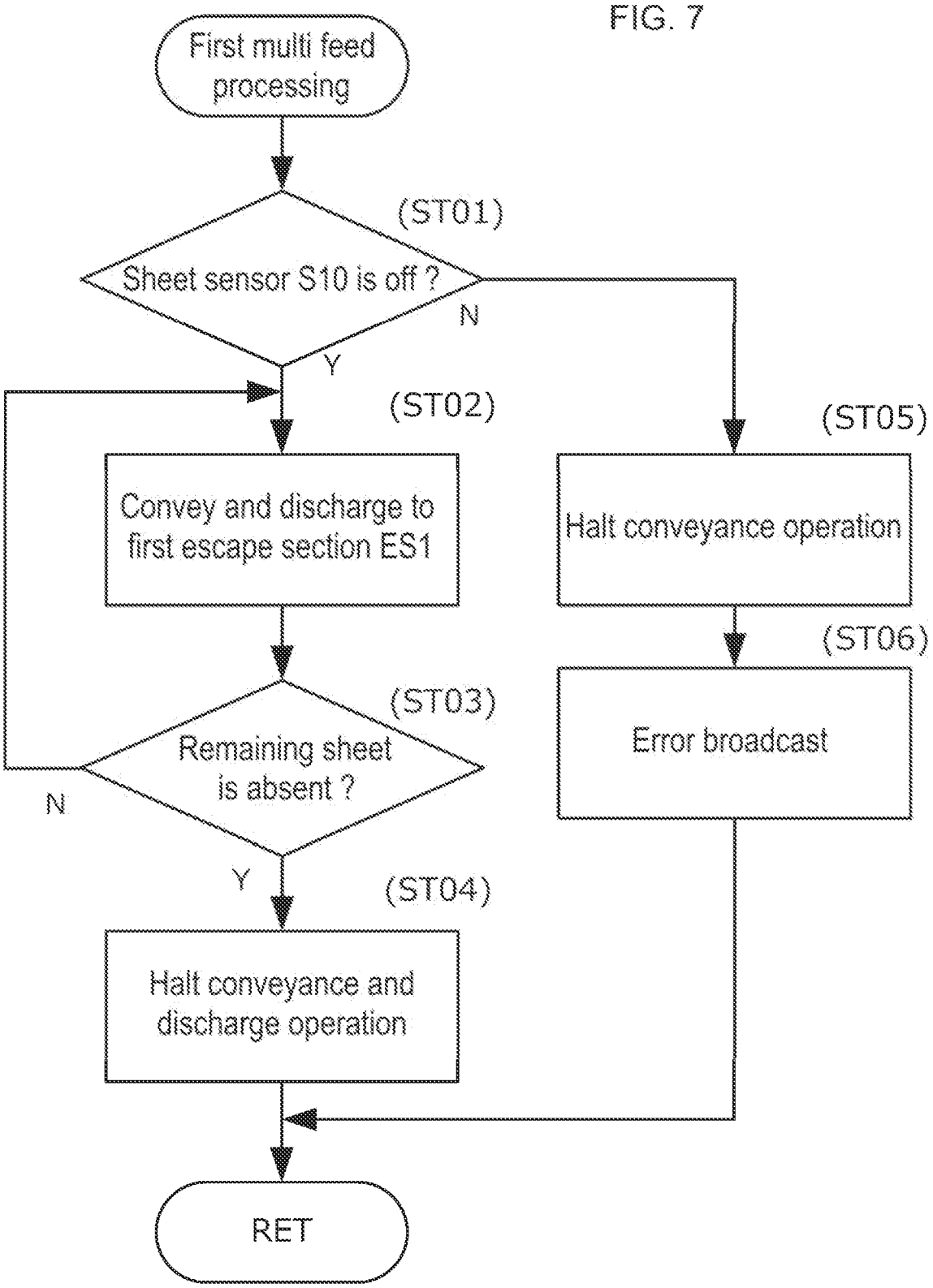
FIG. 7 is a flowchart diagram illustrating the first multi feed processing in the sheet feeding apparatus according to the present invention.

First, the first multi feed processing will be described based on state views of FIGS. 5A to 6B and flowchart of FIG. 7. FIGS. 5A and 5B illustrate a state of multi-fed sheets PP in the case where multi feed is detected through the conveyance path TR1 or TR2, and FIGS. 6A and 6B illustrate a state of multi-fed sheets PP in the case where multi feed is detected through the conveyance path TR3. In the following description, the multi-fed sheets PP are assumed in a state in which a prior sheet Pa fed early overlaps with a subsequent sheet Pb fed subsequently of the prior sheet Pa.

The first multi feed processing is executed in the first sheet feeding unit DK1, when one of the multi feed sensors DFS1 to DFS3 detects multi feed. In the first multi feed processing, it is determined whether or not the sheet sensor S10 disposed in the vicinity of the upstream side of the flapper FL1 is OFF i.e. the front end of the prior sheet Pa undergoing multi feed is detected at the time one of the multi feed sensors DFS1 to DFS3 detects the multi feed (ST01). When the sheet sensor S10 is OFF (ST01), as shown in FIGS. 5A and 6A, it is determined that the front end of the prior sheet Pa does not reach the flapper FL1, and exists on the upstream side thereof. In such a state, the flapper FL1 disposed in the branch position DP blocks a conveyance direction TD1 toward the connection path TR6, and switches to a conveyance direction TD2 toward the first escape section ES1. Thus, the multi-fed sheets PP are discharged to the first escape section ES1 (ST02). At this point, in the case where a sheet (hereinafter, referred to as a remaining sheet) subsequent to the multi-fed sheets PP remains (ST03), the remaining sheet is also discharged to the first escape section ES1 (ST02). Subsequently, in the case where the remaining sheet does not exist (ST03), operation for conveying and discharging to the first escape section ES1 is halted (ST04).

Figure 13:
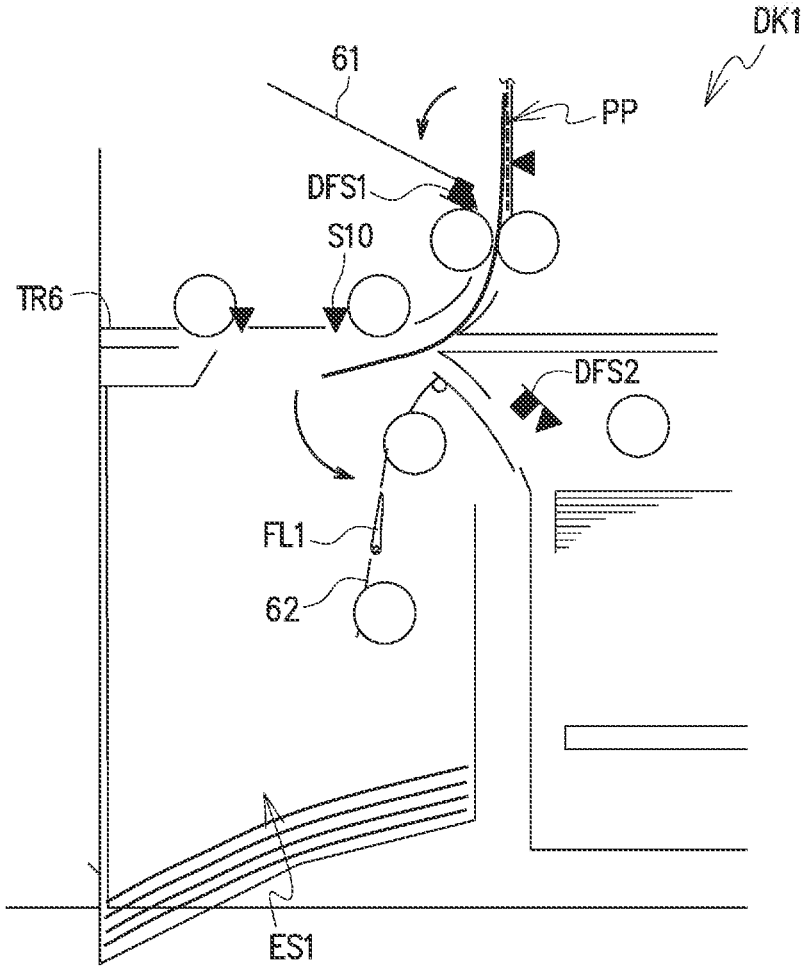
FIG. 13 is a schematic view illustrating a configuration for opening a conveyance path in the sheet feeding apparatus according to the present invention.

On the other hand, when the sheet sensor S10 is ON (ST01) at the time one of the multi feed sensors DFS1 to DFS3 detects multi feed, as shown in FIGS. 5B and 6B, it is recognized that the front end of the prior sheet Pa already passes through the flapper FL1, and operation for conveying the multi-fed sheets PP is halted (ST05). Subsequently, a user is informed of a jam of the multi-fed sheets PP using means for displaying the jam on the display section 103 of the image forming apparatus 101, generating an audible alarm or the like (ST06). In addition, in the case of the jam, as shown in FIG. 13, by opening conveyance guides 61, 62, and the like, the user removes the multi-fed sheets PP jammed on the first conveyance path TR10 and remaining sheet.

Figure 10:
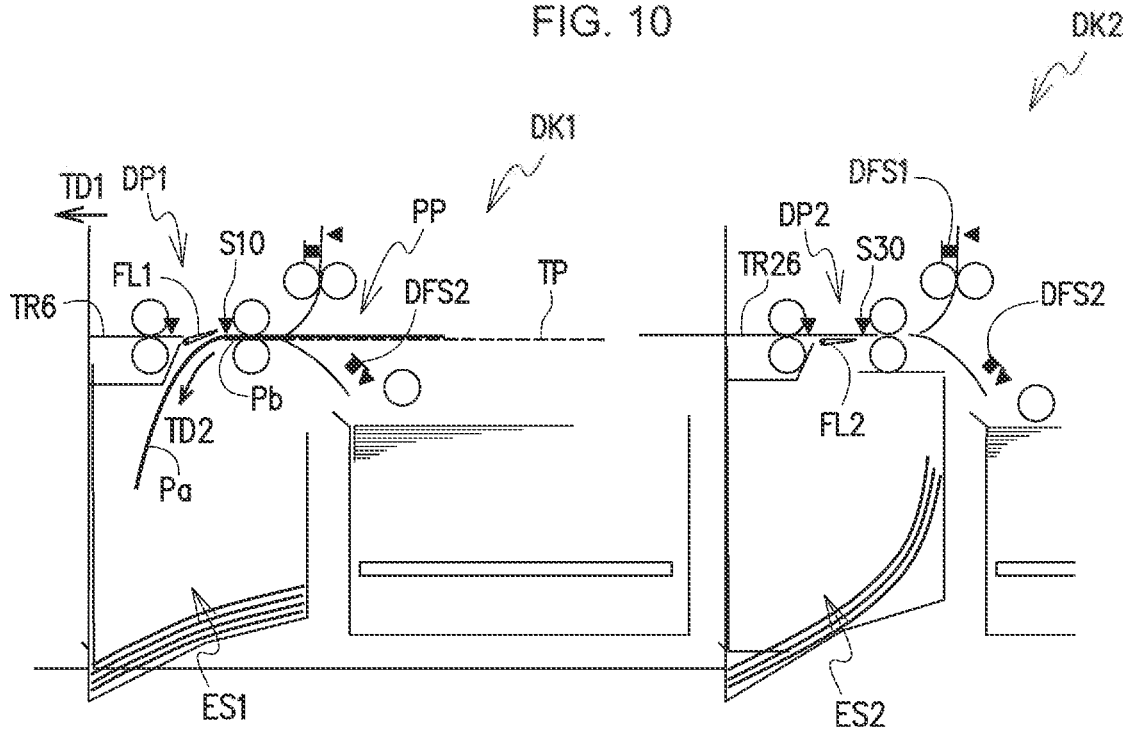
FIG. 10 is still another state view illustrating the second multi feed processing in Embodiment 1 of the sheet feeding apparatus according to the present invention.
Figure 11:
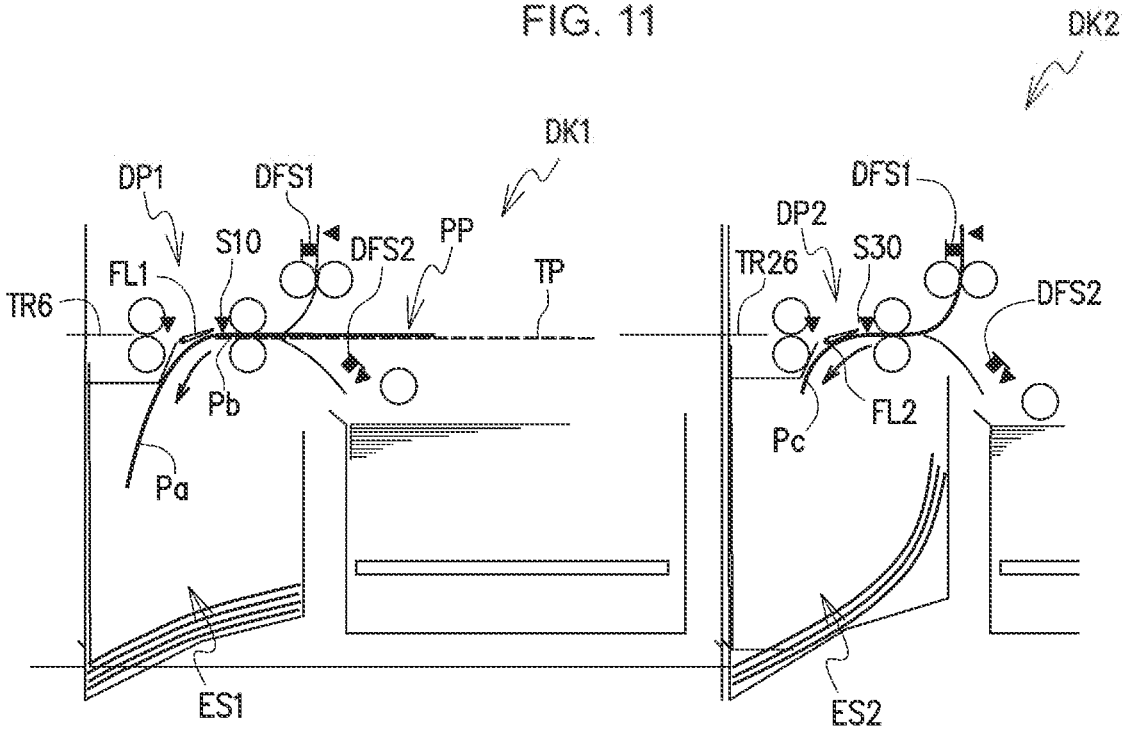
FIG. 11 is still another state view illustrating the second multi feed processing in Embodiment 1 of the sheet feeding apparatus according to the present invention.
Figure 12:
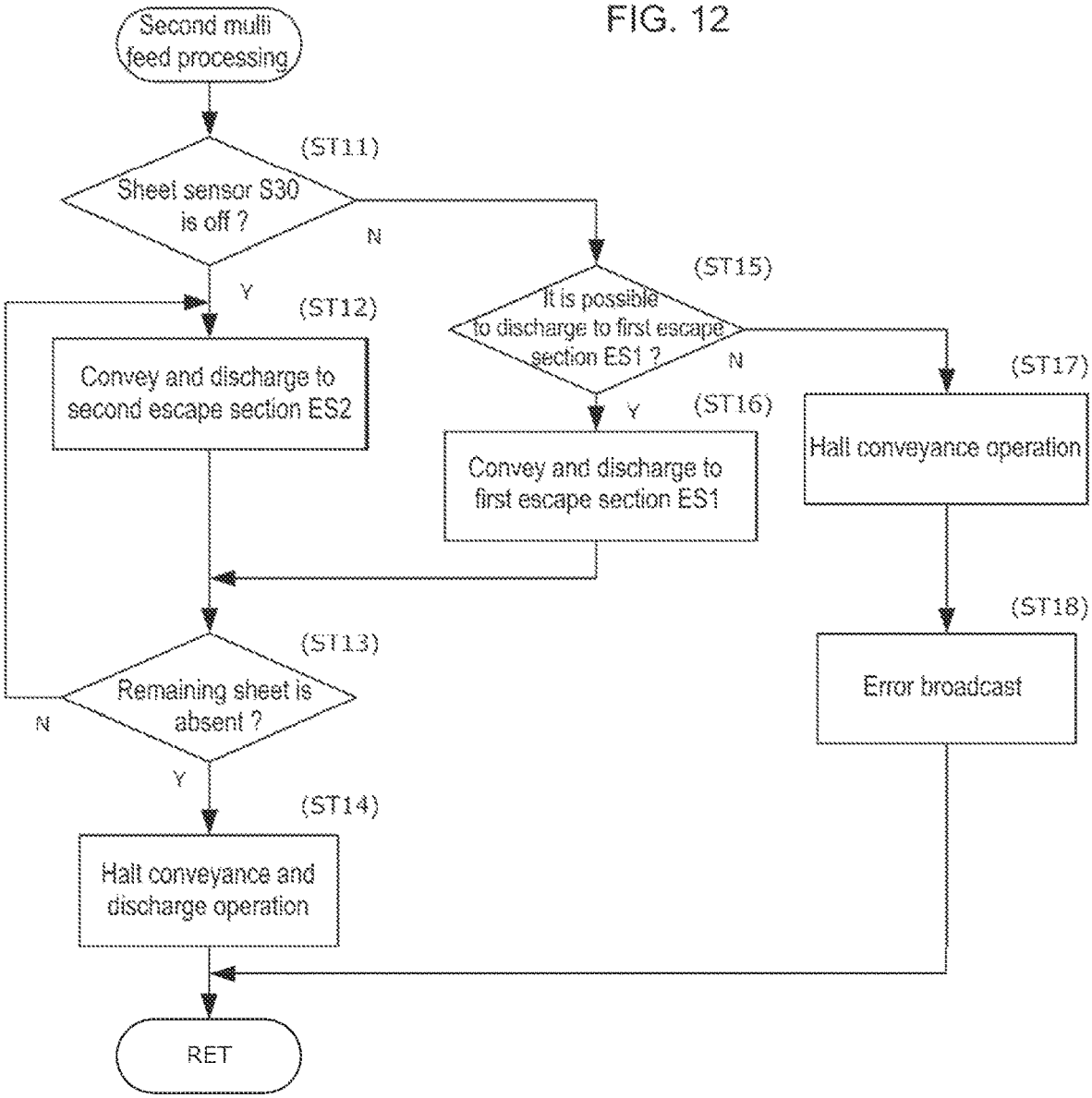
FIG. 12 is a flowchart diagram illustrating the second multi feed processing in Embodiment 1 of the sheet feeding apparatus according to the present invention.

Next, the second multi feed processing in Embodiment 1 will be described based on state views in FIGS. 8 to 11 and flowchart in FIG. 12. The second multi feed processing is executed in the case where multi feed is detected by one of the multi feed sensors DFS1 and DFS2 of the second sheet feeding unit DK2 coupled to the first sheet feeding unit DK1. In addition, multi feed processing in the first sheet feeding unit DK1 on the downstream side is the same as the above-mentioned first multi feed processing.

Figure 8:
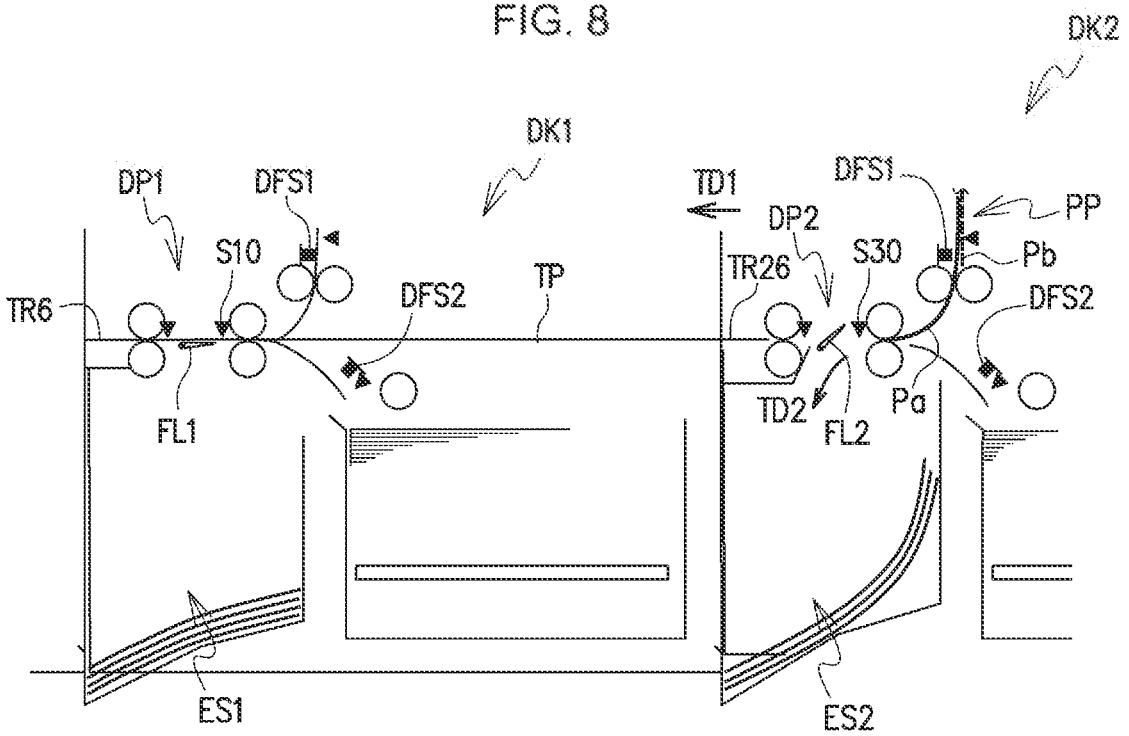
FIG. 8 is a state view illustrating second multi feed processing in Embodiment 1 of the sheet feeding apparatus according to the present invention.

First, it is determined whether or not the sheet sensor S30 disposed in the vicinity of the upstream side of a flapper FL2 of the second sheet feeding unit DK2 is OFF i.e. the sheet sensor S30 detects the prior sheet Pa at the time one of the multi feed sensors DFS1 and DFS2 of the second sheet feeding unit DK2 detects multi feed (ST11). When the sheet sensor S30 is OFF (ST11), as shown in FIG. 8, it is determined that the front end of the prior sheet Pa does not reach a branch position DP2, and exists on the upstream side of the flapper FL2. In such a state, the flapper FL2 disposed in the branch position DP2 blocks the conveyance direction TD1 toward the connection path TR26, and switches to the conveyance direction TD2 toward the second escape section ES2. Thus, the multi-fed sheets PP are discharged to the second escape section ES2 (ST12). In the case where a remaining sheet exists in a conveyance path on the upstream side of the multi-fed sheets PP (ST13), the remaining sheet is also discharged to the second escape section ES2 successively (ST12). Subsequently, in the case where the multi-fed sheets PP and remaining sheet do not exist (ST13), operation for conveying and discharging to the second escape section ES2 is halted (ST14).

Figure 9:
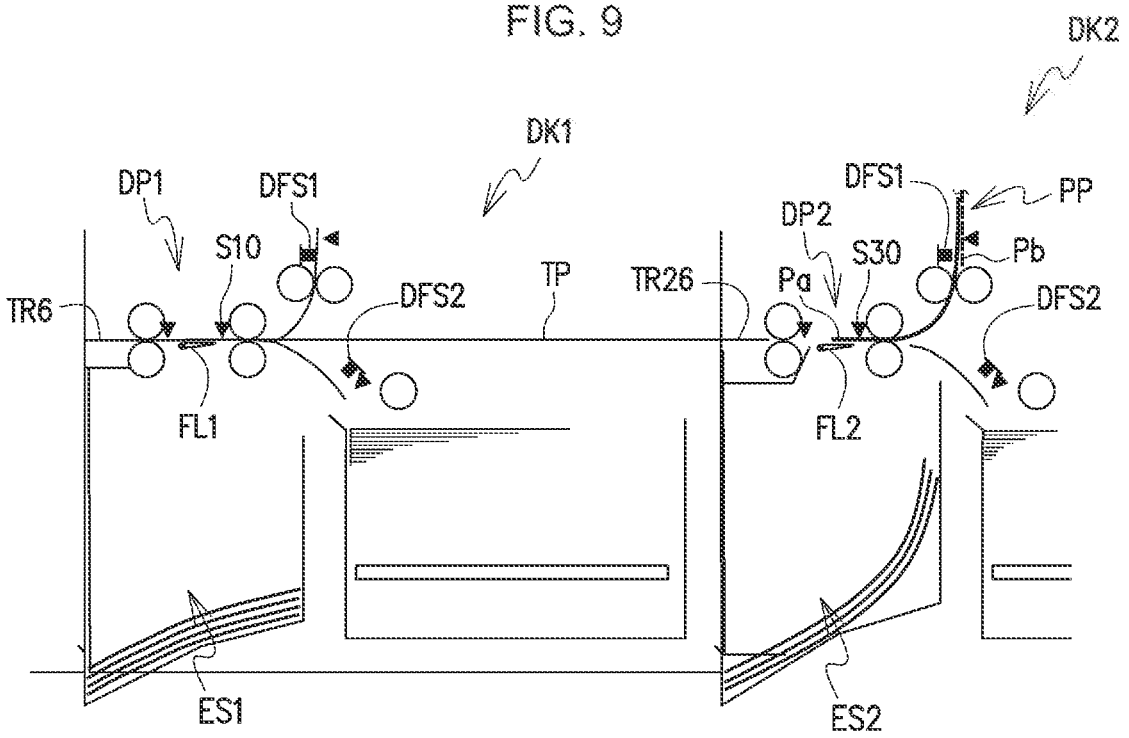
FIG. 9 is another state view illustrating the second multi feed processing in Embodiment 1 of the sheet feeding apparatus according to the present invention.

On the other hand, when the sheet sensor S30 is ON (ST11) at the time one of the multi feed sensors DFS1 and DFS2 of the second sheet feeding unit DK2 detects multi feed, as shown in FIG. 9, it is recognized that the front end of the prior sheet Pa already passes through the flapper FL2, and concurrently, it is ascertained whether or not it is possible to discharge to the first escape section ES1 (ST15). When it is possible to discharge to the first escape section ES1, the multi-fed sheets PP are guided to the first conveyance path TR10 of the first sheet feeding unit DK1 via the through pass section TP. Then, as shown in FIG. 10, the flapper FL1 blocks the conveyance direction TD1 toward the connection path TR6, and switches to the conveyance direction TD2 toward the first escape section ES1. Thus, the multi-fed sheets PP with the multi feed detected in the second sheet feeding unit DK2 are discharged to the first escape section ES1 (ST16). At this point, as shown in FIG. 11, in the case where a remaining sheet Pc subsequent to the multi-fed sheets PP remains in the second sheet feeding unit DK2 (ST13), the remaining sheet Pc is discharged to the second escape section ES2 (ST12). Subsequently, in the case where the remaining sheet does not exist (ST13), operation for conveying and discharging to the second escape section ES2 is halted (ST14).

In the case where it is determined that discharge to the first escape section ES1 is disabled (ST15), conveyance operation of the multi-fed sheets PP is halted (S17), and a user is informed of a jam of the multi-fed sheets PP using the means for displaying the jam on the display section 103 of the image forming apparatus 101, generating an audible alarm or the like (ST18). In addition, the case of disabling discharge to the first escape section ES1 is the case where the first escape section ES1 is full of sheets, the case where a jam occurs in the through pass section TP or the first conveyance path 10 of the first sheet feeding unit DK1, and the like. As a matter of course, also in the case where both of the first and second escape sections ES1, ES2 are full, conveyance operation for the multi-fed sheets PP is halted. As shown in FIG. 8, it is possible to remove the multi-fed sheets PP and remaining sheet on the first and second conveyance paths TR10, TR20, by opening the conveyance guides 61, 62.

In addition, in the above-mentioned first and second multi feed processing, it is determined whether or not the front end of the multi-fed sheets PP passes through the flapper FL1 or FL2 by ON/OFF of the sheet sensor S10 or S30, respectively. Further, the sheet front end may be detected at the time the multi feed sensor is ON based on a sheet conveyance amount from the time of detecting the front end of the sheets by the sheet sensor S10 or S30 to determine whether or not the front end passes through the flapper FL1 or FL2 using the detection position.

Embodiment 2

Figure 14:
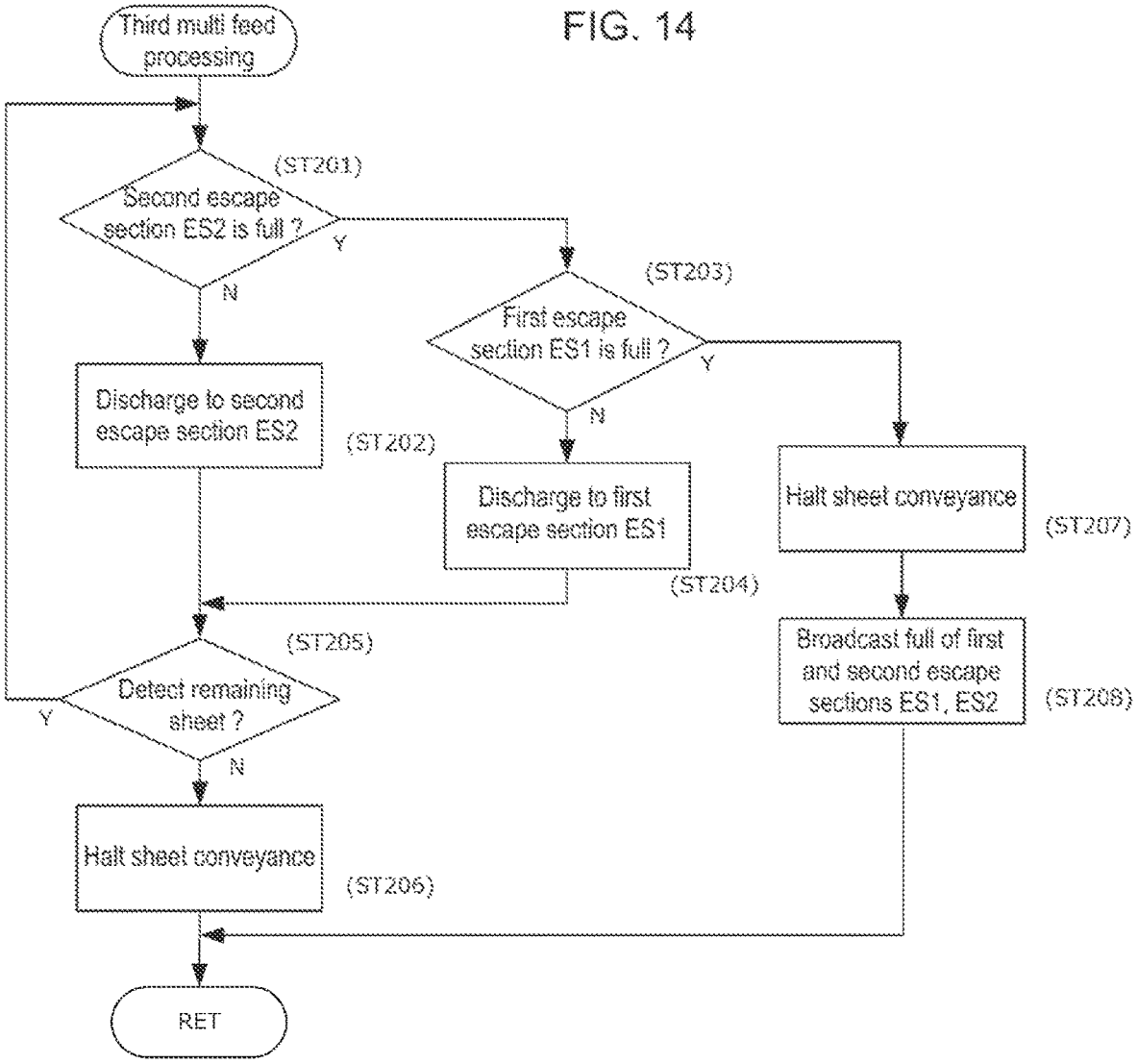
FIG. 14 is a flowchart diagram illustrating third multi feed processing in Embodiment 2 of the sheet feeding apparatus according to the present invention.
Figure 15A:
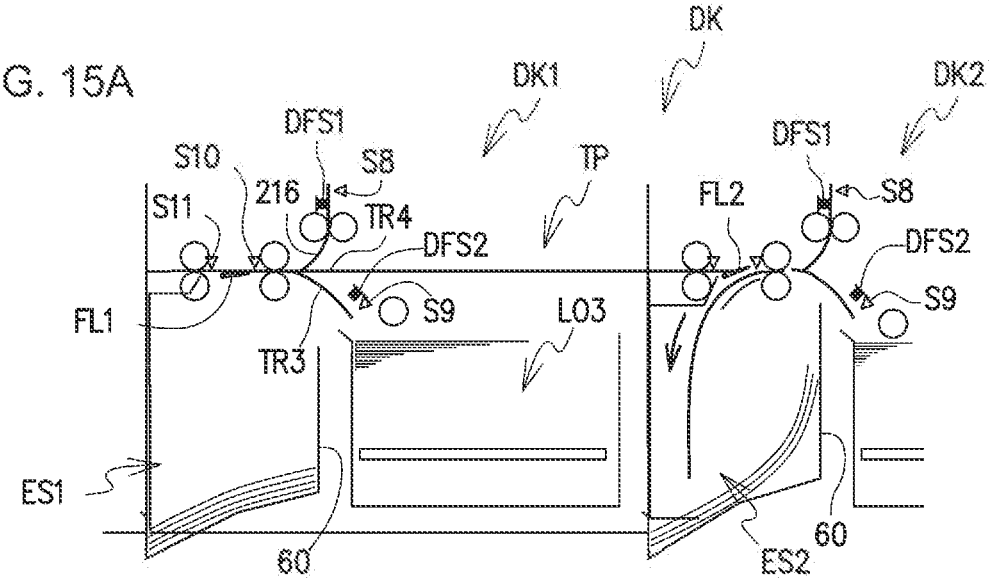
FIGS. 15A to 15C are state views illustrating the third multi feed processing in Embodiment 2 of the sheet feeding apparatus according to the present invention.
Figure 15B:
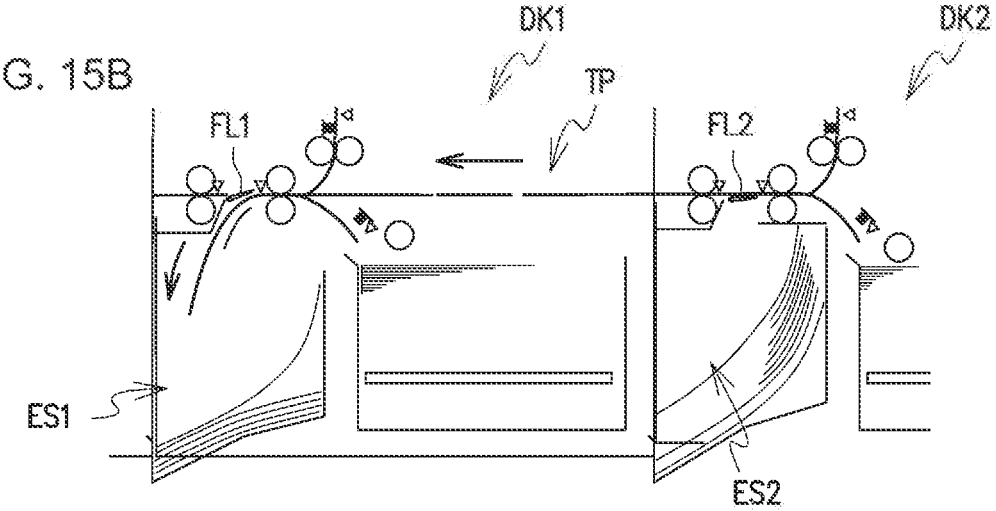
Figure 15C:
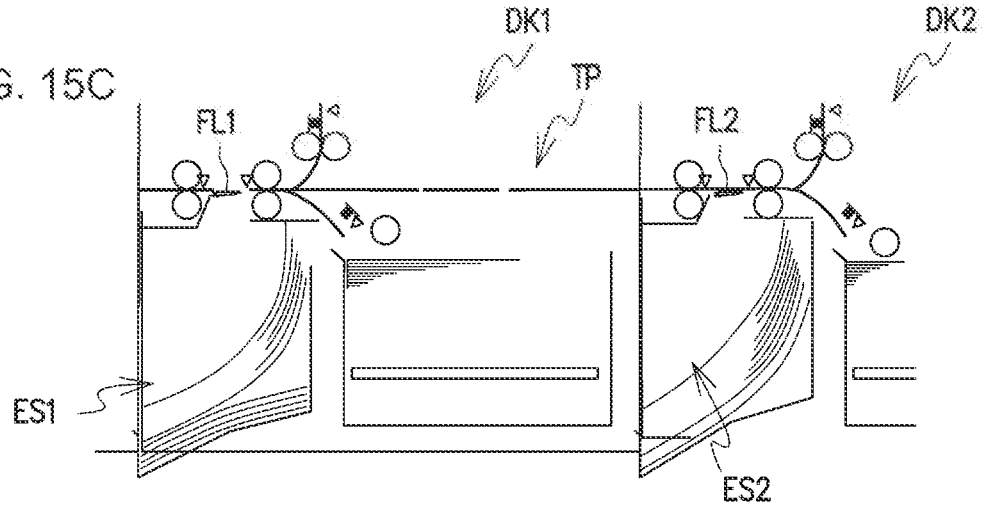

Embodiment 2 of multi feed processing according to the present invention will be described. FIG. 14 is a flowchart of third multi feed processing in Embodiment 2, and FIGS. 15A to 15C are state views of the third multi feed processing. In the sheet feeding apparatus DK, the first and second escape sections ES1, ES2 are provided with first and second full detecting sections for detecting full of sheets, respectively. In Embodiment 2, in the case of detecting that the second escape section ES2 is full, it is controlled to convey multi-fed or remaining sheet P2 to the first escape section ES1 of the first sheet feeding unit DK1. In addition, the multi-fed and remaining sheet of the first sheet feeding unit DK1 is guided by the flapper FL1 and is discharged to the first escape section ES1.

The multi feed processing in Embodiment 2 will be described based on the flowchart of FIG. 14. In the processing, at the time one of the multi feed sensors DFS1 and DFS2 of the second sheet feeding unit DK2 detects multi feed, it is detected whether or not the second escape section ES2 is in a full state (ST201). When the section is not in the full state, the multi-fed sheets occurring in the second sheet feeding unit DK2 are discharged to the second escape section ES2 without any processing (ST202), (FIG. 15A).

Subsequently, in the case where a remaining sheet further exists, the flow returns again to the step (ST201), and it is detected whether or not the second escape section ES2 is in a full state. At this point, when the second escape section ES2 is not in the full state by discharge of the multi-fed sheets to the second escape section ES2 previously, as shown in FIG. 15A, the remaining sheet is also discharged to the second escape section ES2.

On the other hand, in the case where the second escape section ES2 is in the full state at the time one of the multi feed sensors DFS1 and DFS2 of the second sheet feeding unit DK2 detects multi feed, it is detected whether or not the first escape section ES1 of the first sheet feeding unit DK1 is in a full state (ST203). When the first escape section ES1 is not in the full state, the multi-fed sheets are conveyed to the first sheet feeding unit DK1 through the through pass section TP, guided by the flapper FL1, and are discharged to the first escape section ES1 (ST204), (FIG. 15B).

Subsequently, in the case where a remaining sheet further exists, the flow returns again to the step (ST201), and it is detected whether or not the second escape section ES2 is in a full state. At this point, since the second escape section ES2 is in the full state already at the time of discharging the prior multi-fed sheets, as shown in FIG. 15B, the remaining sheet is also discharged to the first escape section ES1.

In the case where the first escape section ES1 is in the full state in step (ST203), sheet conveyance operation is halted (FIG. 15C), and the image forming apparatus 101 is informed that the first escape section ES1 and second escape section ES2 are in full states (ST207, ST208). Upon responding to the information, the image forming apparatus 101 performs full error display on the display section 103. Then, when all remaining sheets in the conveyance path of the sheet feeding apparatus DK are conveyed and discharged to the first escape section ES1 and second escape section ES2, operation of conveyance and discharge is halted in the sheet feeding apparatus DK (ST206).

Figure 16:
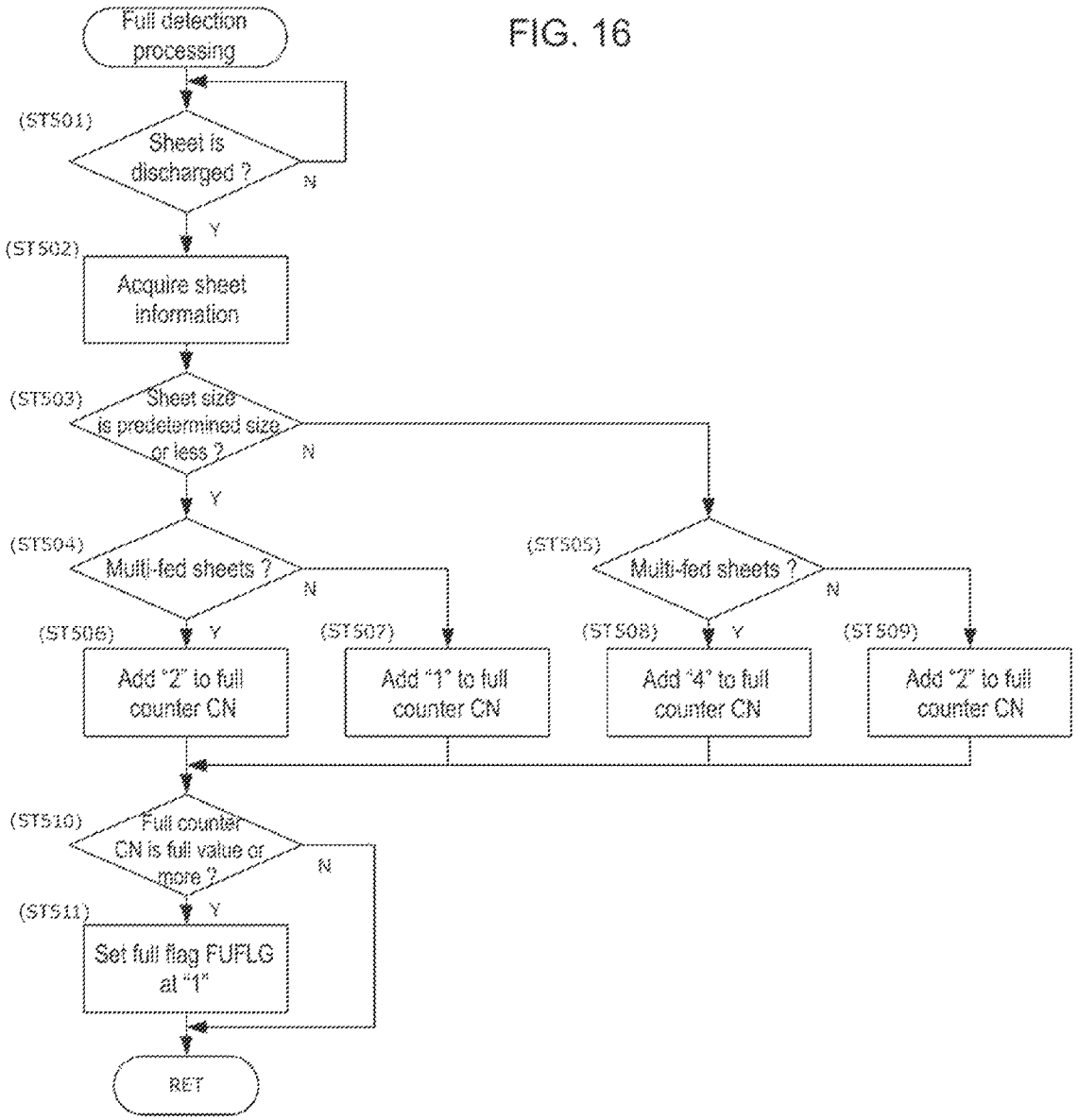
FIG. 16 is a flowchart diagram illustrating full detecting processing in the sheet feeding apparatus according to the present invention.

Herein, based on the flowchart in FIG. 16, one example will be described in the full detecting section for determining whether or not each of the first escape section ES1 and second escape section ES2 is in the full state due to conveyed multi-fed sheets. In addition, the first escape section ES1 and second escape section ES2 in this Embodiment are the same configuration, and further, the first full detecting section for detecting the full state of the first escape section ES1 and the second full detecting section for detecting the full state of the second escape section ES2 are the same configuration. Accordingly, herein, the description will be given to only the second full detecting section for detecting the full state of the second escape section ES2.

Since the second escape section ES2 of this Embodiment is a structure for dropping the sheet to discharge, a storage amount varies with sizes of sheets discharged to the second escape section ES2. Therefore, detection of the full state of the second escape section ES2 is detected by counting values defined by the size of the sheet discharged to the second escape section ES2. In other words, the number of sheets of a predetermined size making the full state is beforehand measured and is defined as an upper limit value (full value), and a size larger than the predetermined size is made 2 counts. For example, when the predetermined size is A4, it is assumed that A4, A5, A6 and so on are 1 count (equivalent to 1 sheet), and that B4, A3 and so on are 2 counts (equivalent to 2 sheets). The full detecting section is provided with the sheet sensor S10 for detecting the sheet, a full counter CN for counting the sheet, full flag FUFLG and the like, and detects the full state by full detecting processing shown in FIG. 16.

The second full detecting section is executed whenever multi-fed sheets or remaining sheet is discharged to the second escape section ES2. First, it is detected whether or not a sheet is discharged to the second escape section ES2 (ST501). Specifically, in a state in which the flapper FL2 is in the position for conveying the sheet in the conveyance direction TD2, the presence or absence of discharge is determined by whether or not the sheet sensor S10 disposed in the second escape section ES2 detects the sheet.

When the sheet is detected, information (size) on the sheet is acquired from the image forming apparatus 101 (ST502). Then, it is determined whether or not the sheet size is the predetermined size or less from the acquired sheet information (ST503). When the size is the predetermined size or less, it is determined whether the sheet is multi-fed sheets or a remaining sheet. When the sheet is the multi-fed sheets, it is regarded as that two sheets are conveyed and discharged, while overlapping, and "2" is added to the full counter CN (ST504, ST508).

On the other hand, when the sheet is the remaining sheet, "1" is added to the full counter CN (ST504, ST507). When the sheet is multi-fed sheets of a large size (L size) larger than the predetermined size, "4" is added to the full counter CN (ST505, ST508). On the other hand, when the sheet is the remaining sheet of the L size, "2" is added to the full counter CN (ST505, ST509). In addition, in the multi feed processing of this Embodiment, since it is configured that multi-fed sheets with the multi feed detected by one of the multi feed sensors DFS1 and DFS2 of the second sheet feeding unit DK2 are first discharged to the second escape section ES2, determination of multi-fed sheets is made by whether or not the sheet is the first discharged sheet.

Next, an added count value of the full counter CN is compared with the beforehand set full value. When the value is the full value or more, it is determined that the second escape section ES2 is in the full state and the full flag FULFLG is set at "1" (ST510, ST511). On the other hand, when the count value of the full counter CN is a value smaller than the beforehand set full value, it is determined that the second escape section ES2 is not in the full state (ST510). For example, it is possible to configure to reset the full flag FUFLG (set the full flag FUFLG at "1"), by detecting open/close of an open/close cover (not shown) for covering the second escape section ES2. In other words, by open/close operation for the open/close cover, it is possible to determine that all failed sheets discharged to the escape section ES are removed.

In addition, as shown in the above-mentioned Embodiment, in the escape section having a box-shaped discharge tray by dropping the sheet and thereby discharging, since there is the case where a plurality of different types of sheets is discharged, weighting (coefficient) may be set corresponding to the size, thickness, material and like of the sheet to detect full of sheets by the number of sheets and weighting.

Further, it may be possible to provide a scheme for placing an optical sensor in an upper portion of the escape section to detect full of sheets, and another scheme for providing the upper portion of the escape section with a mechanical sensor lever to detect operation of the sensor lever with an optical sensor.

Embodiment 3

Embodiment 3 in multi feed processing will be described next. In the above-mentioned Embodiment 1, it is selected to discharge to the first or the second escape section ES1, ES2, corresponding to the front end position of multi-fed sheets at the time one of the multi feed sensors DFS1 and DFS2 of the second sheet feeding unit DK2 detects multi feed. In Embodiment 2, it is selected to discharge to the first or the second escape section ES1, ES2, corresponding to the storage state of the second escape section ES2 at the time one of the multi feed sensors DFS1 and DFS2 of the second sheet feeding unit DK2 detects multi feed. In Embodiment 3, it is selected to discharge to the first or the second escape section ES1, ES2, corresponding to storage states of the first escape section ES1 and second escape section ES2 at the time one of the multi feed sensors DFS1 and DFS2 of the second sheet feeding unit DK2 detects multi feed.

Embodiment 3 will be further described in detail. The control section CON2 of the second sheet feeding unit DK2 acquires information on a storage state of the first escape section ES1 from the control section CON1 of the first sheet feeding unit DK1, compares between values corresponding to the numbers of sheets stored in the first escape section ES1 and second escape section ES2, and from a result of comparison, selects the first or second escape section ES1, ES2 to discharge. In this Embodiment, with respect to a single sheet, the value to compare is a cumulative numeric value obtained by multiplying by a coefficient corresponding to a length of the sheet. As a matter of course, the control section CON2 may simply compare between the numbers of sheets, and from the compared result, select the first or second escape section ES1, ES2 to discharge.

Figure 17:
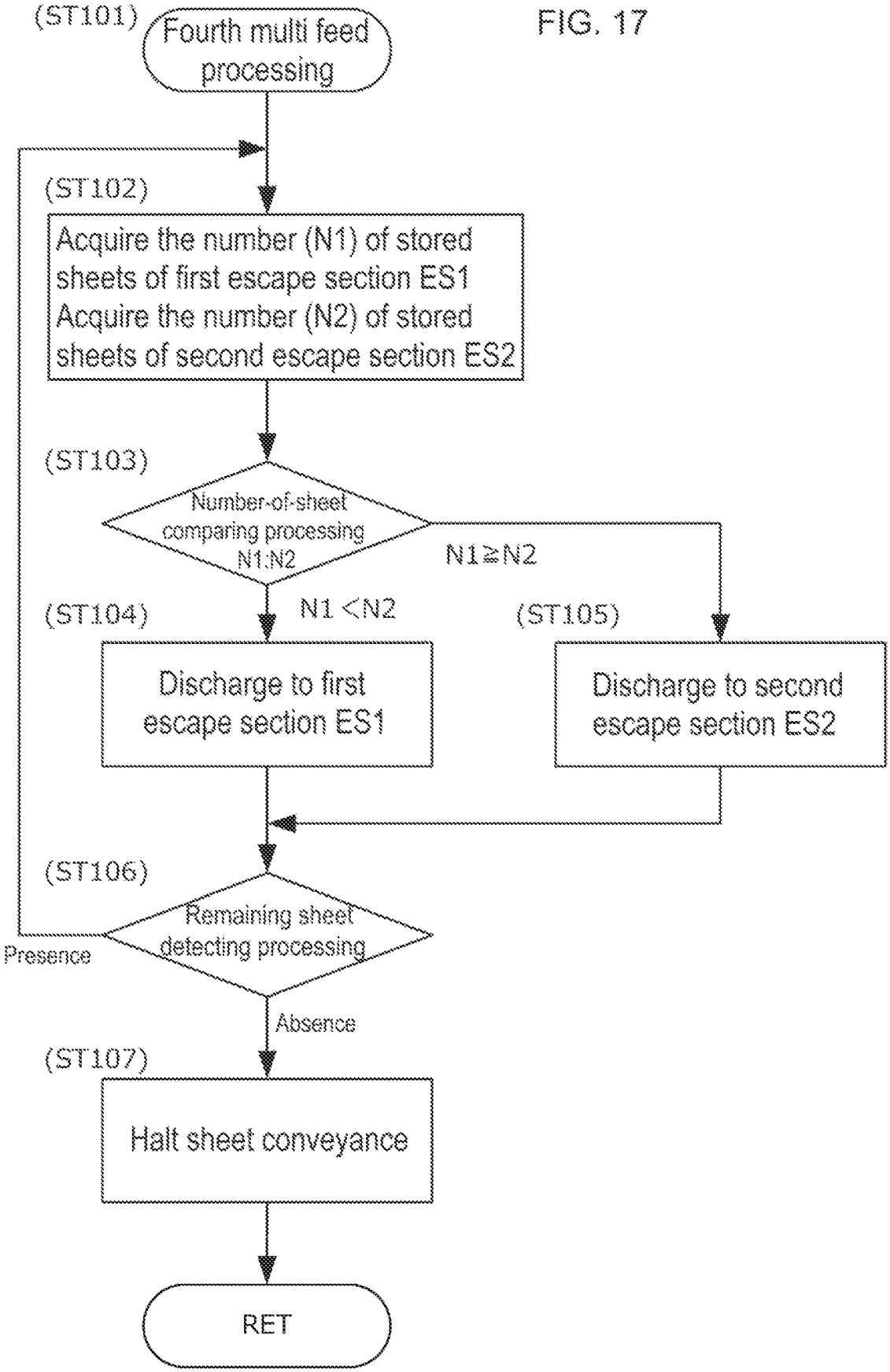
FIG. 17 is a flowchart diagram illustrating fourth multi feed processing in Embodiment 3 of the sheet feeding apparatus according to the present invention.

In the fourth multi feed processing in Embodiment 3, with respect to a single sheet, by multiplying by the coefficient corresponding to the length of the sheet, and comparing between cumulative numeric values thereof, the control section CON2 selects the first or second escape section ES1, ES2 to discharge. Operation of the fourth multi feed processing will be described below based on a flowchart shown in FIG. 17 and a state view shown in FIGS. 18A and 18B.

Figure 18A:
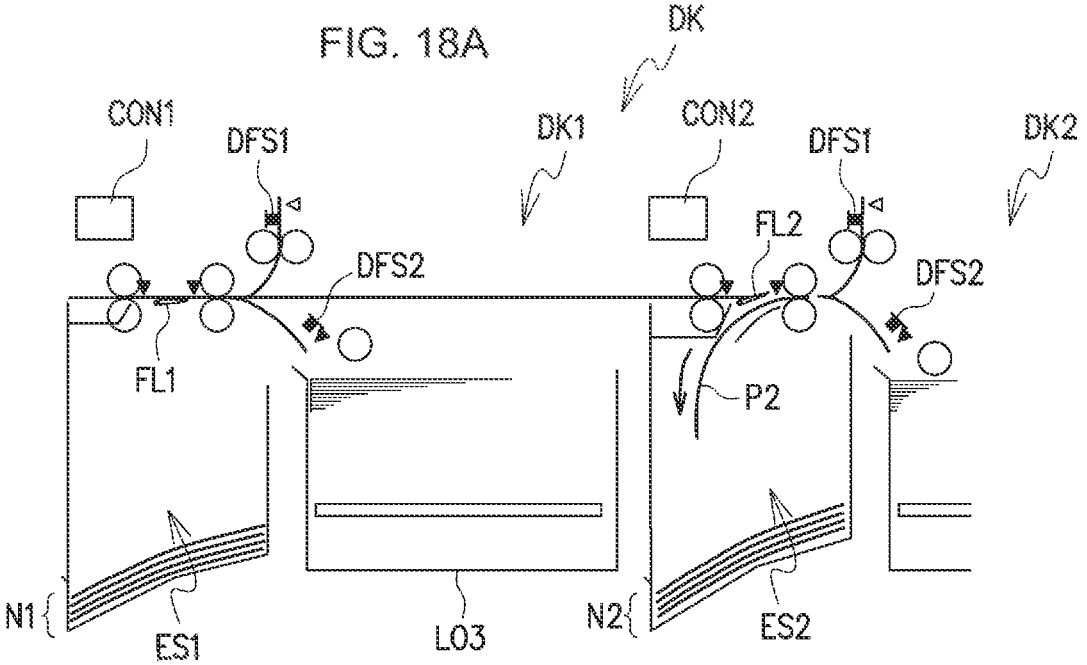
FIGS. 18A and 18B are state views illustrating the fourth multi feed processing in Embodiment 3 of the sheet feeding apparatus according to the present invention.

When one of the multi feed sensors DFS1 and DFS2 of the second sheet feeding unit DK2 detects multi feed and the multi feed processing is started (ST101), first, the control section CON2 acquires number-of-sheet information (N1, N2) of sheets discharged to the first and second escape sections ES1, ES2 (ST102). Then, in number-of-sheet comparing processing (ST103), the section compares between the numbers of stored sheets in the first and second escape sections ES1, ES2. Herein, when N1≥N2, multi-fed sheets P2 occurring in the second sheet feeding unit DK2 are discharged to the second escape section ES2 (ST105), (FIG. 18A). In addition, the case where any sheet is not discharged and both of the first and second escape sections ES1, ES2 are empty is also regarded as the same, multi-fed sheets occurring in the first and second sheet feeding units DK1, DK2 are respectively discharged to first and second escape sections ES1, ES2.

Figure 18B:
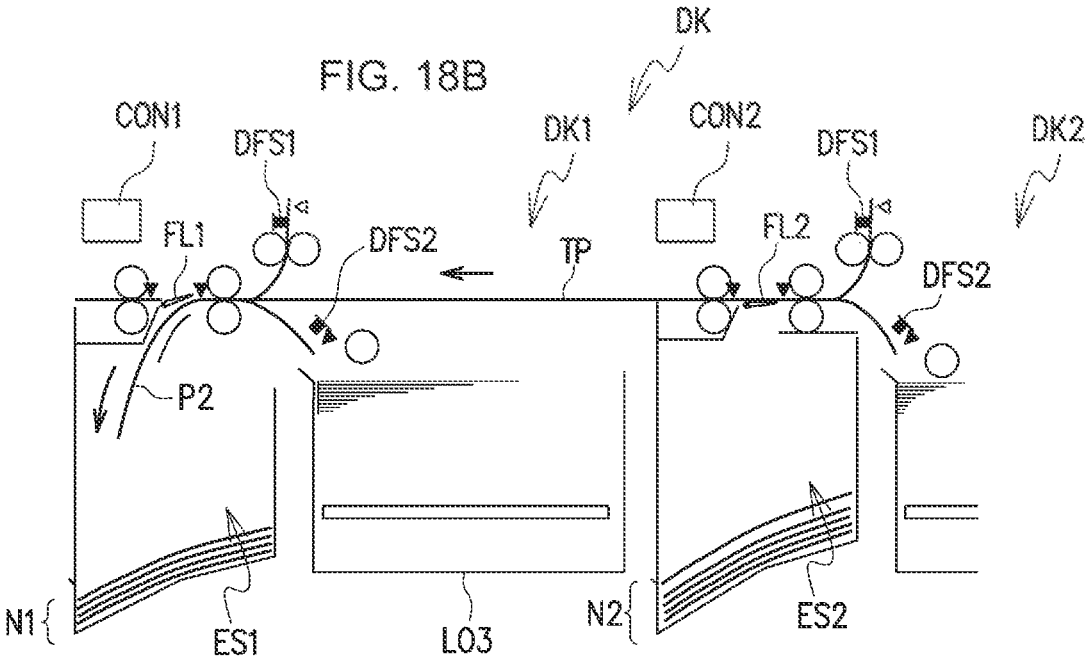

On the other hand, when N1<N2, since sheets stored in the second escape section ES2 are higher in number than sheets stored in the first escape section ES1, the multi-fed sheets P2 are conveyed toward the first sheet feeding unit DK1 via the through pass section TP, and are discharged to the first escape section ES1 (ST104), (FIG. 18B).

In remaining sheet detection processing (ST106), after finishing allocation of the multi-fed sheets to the first escape section ES1 or the second escape section ES2 in the number-of-sheet comparing processing (ST103), it is detected whether or not a remaining sheet left in the conveyance path exists. Then, when the remaining sheet is detected, the flow returns to step 101 (ST101), and the remaining sheet is allocated. On the other hand, when any remaining sheet is not detected, sheet conveyance is halted (ST107).

In other words, in the case where a certain amount of multi-fed sheets and remaining sheets in the first sheet feeding unit DK1 are stored in the first escape section ES1, and the lower number of sheets is stored in the second escape section ES2, multi-fed sheets and remaining sheets of the second sheet feeding unit DK2 are successively discharged to the second escape section ES2 until reaching the number of stored sheets of the first escape section ES1. In addition, also in Embodiment 3, when full states are detected in both of the first and second escape sections ES1, ES2, full error display is performed on the display section 103 of the image forming apparatus 101.

Figure 19:
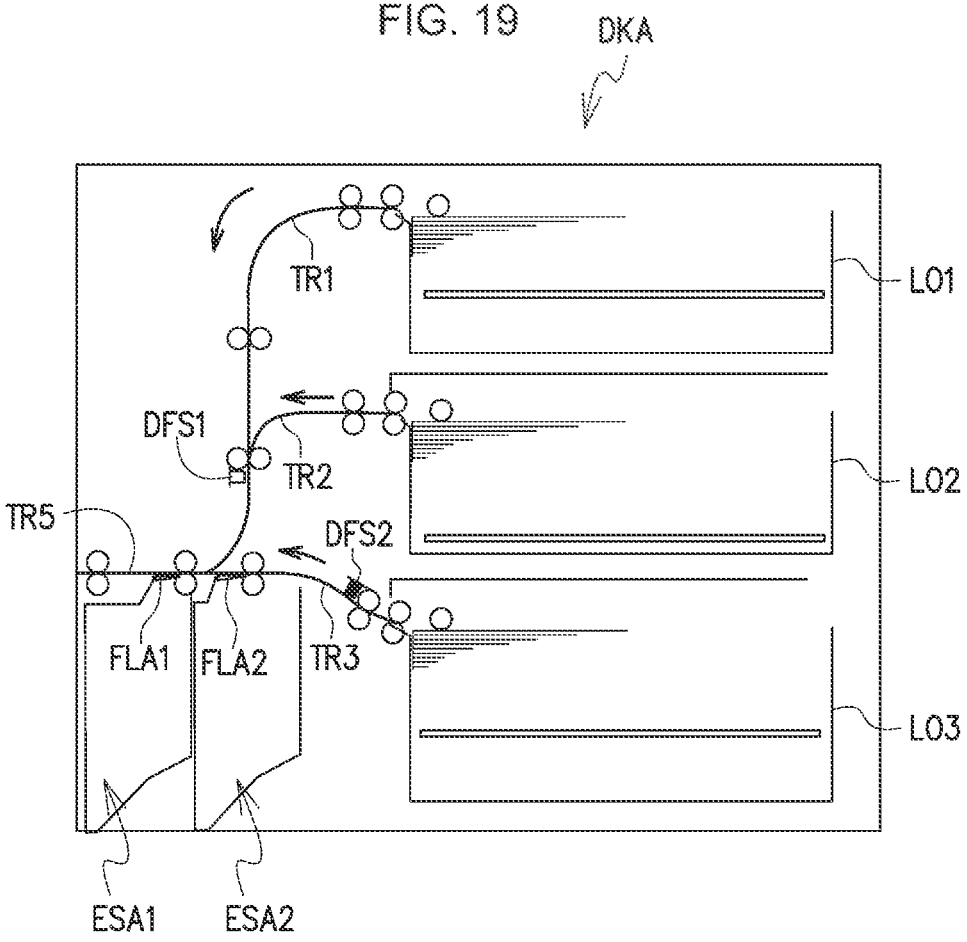
FIG. 19 is a configuration view illustrating a configuration of another sheet feeding apparatus with the present invention applied.

Herein, the above-mentioned description illustrates one example of applying the multi feed processing illustrated in Embodiments 1 to 3 to the sheet feeding apparatus DK as shown in FIGS. 3 and 4 for coupling the first and second sheet feeding units DK1, DK2 each provided with the first to third storage chambers LO1 to LO3. Further, as shown in FIG. 19, the second to fourth multi feed processing of the second sheet feeding unit DK2 illustrated in Embodiments 1 to 3 is also applicable to a sheet feeding apparatus DKA provided with the first to third storage chambers LO1 to LO3, a first escape section ESA1 provided in the conveyance path TR5 merged with the conveyance paths TR1, TR2 and TR3 for conveying sheets from the first to third storage chambers LO1 to LO3, and a second escape section ESA2 provided in the conveyance path TR3 for conveying the sheet from the third storage chamber LO3. In the sheet feeding apparatus DKA shown in FIG. 19, the first sheet feeding unit DK1 of Embodiments 1 to 3 is replaced with first and second cassettes LO1, LO2, the second sheet feeding unit DK2 is replaced with the third cassette LO3 of FIG. 20, the first and second escape sections ES1, ES2 are respectively replaced with the first and second escape sections ESA1, ESA2, and the processing is applied.

In Embodiment 3, comparison is performed between sheet storage states in the first escape section ES1 and second escape section ES2, and multi-fed sheets or remaining sheet is allocated and discharged to the section with a lower storage amount. In Embodiment 4, the sheet is allocated and discharged to the first escape section ES1 and second escape section ES2, corresponding to the size of the sheet.

In addition, in the above-mentioned Embodiments 2 and 3, the first multi feed processing is applicable to the multi feed processing of the first sheet feeding unit DK1 on the downstream side. Further, in the above-mentioned description, the second to fourth multi feed processing is described separately, and it is also possible to provide all of the second to fourth multi feed processing or a plurality of types of multi feed processing.

Embodiment 4

Figure 20:
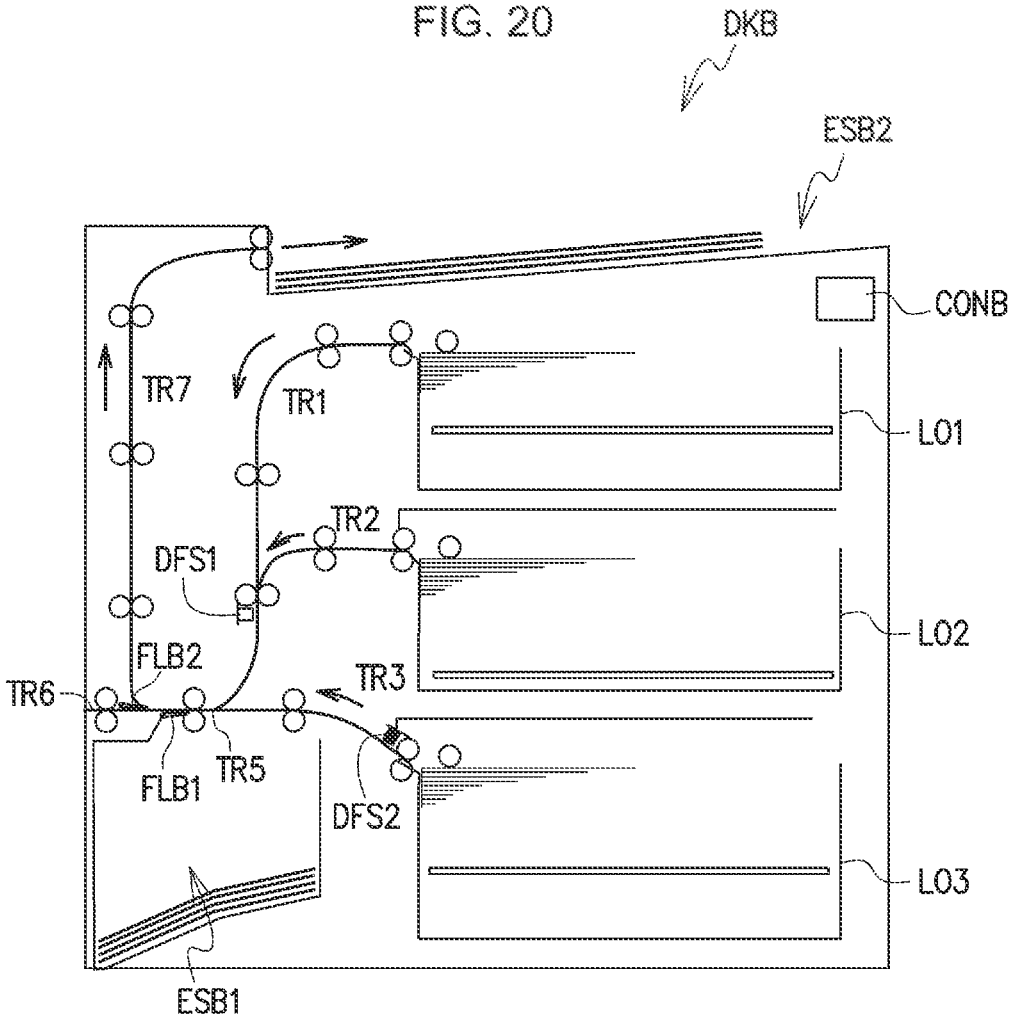
FIG. 20 is a state view illustrating fifth multi feed processing in Embodiment 4 of the sheet feeding apparatus according to the present invention.
Figure 21:
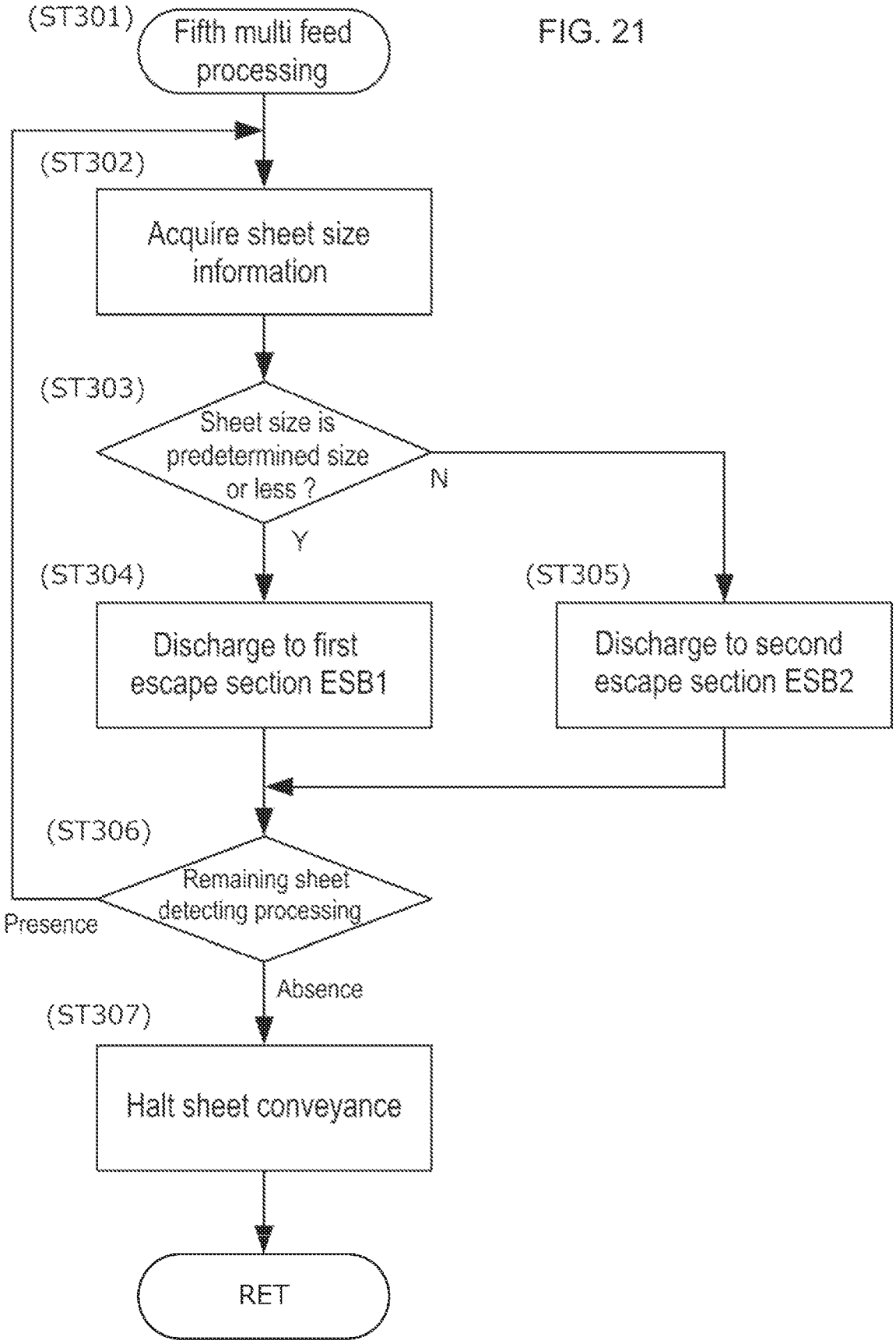
FIG. 21 is a flowchart diagram illustrating the fifth multi feed processing in Embodiment 4 of the sheet feeding apparatus according to the present invention.

FIG. 20 is a view illustrating a configuration of a sheet feeding apparatus DKB to which Embodiment 4 is applicable, and FIG. 21 illustrates a multi feed processing flow. In this Embodiment, a control section CONB controls to discharge sheets of a predetermined size or less to one of the first and second escape sections ESB1, ESB2, and discharge sheets of sizes larger than the predetermined size to the other escape section. Herein, it is assumed that multi-fed sheets and remaining sheets of the A4 size or less are discharged to the first escape section ESB1, and that multi-fed sheets and remaining sheets of sizes larger than A4 are discharged to the second escape section ESB2. The first escape section ESB1 is provided below the conveyance paths TR3, TR5, and the second escape section ESB2 is capable of being provided on the top face of the sheet feeding apparatus DKB with relatively wide space above the conveyance path TR1. By providing on the top face of the sheet feeding apparatus DKB, the second escape section ESB2 is capable of reserving at least a storage face wider than the first escape ESB1, and is capable of supporting also sheets of large sizes. In addition, in this Embodiment 4 is formed a new conveyance path TR7 extending upward toward the second escape section ESB2 from a flapper FLB2 on the upstream side of the connection path TR6 connected to the image forming apparatus 101.

When the control section CONB detects multi-fed sheets passing the conveyance paths TR1, TR2 using the multi feed sensor DFS1, or multi-fed sheets passing the conveyance path TR3 using the multi feed sensor DFS2, the control section CONB acquires size information of the multi-fed sheets (ST302), and makes a size determination (ST303). Herein, when it is determined that the multi-fed sheets are a predetermined size or less, by switching a position of a flapper FLB1 to a direction for guiding to the first escape ESB1, the multi-fed sheets are discharged to the first escape section ESB1 (ST304). On the other hand, when it is determined that the multi-fed sheets are larger than the predetermined size, a position of the flapper FLB2 is switched to a direction for guiding to the second escape ESB2, and the multi-fed sheets are thereby discharged to the second escape section ESB2 (ST305).

In processing for detecting a remaining sheet (ST306), after finishing discharge of multi-fed sheets to the first or second escape section ESB1, ESB2 by sheet size determination processing (ST303), it is detected whether or not a remaining sheet exists. As a result, in the case where the remaining sheet exists, processing for the remaining sheet is started (ST301), and in the case where any remaining sheet does not exist, sheet conveyance is halted (ST307). In addition, when space exists on the bottom side of the sheet feeding apparatus DKB, the second escape section may be provided in the space.

Embodiment 5

Figure 22:
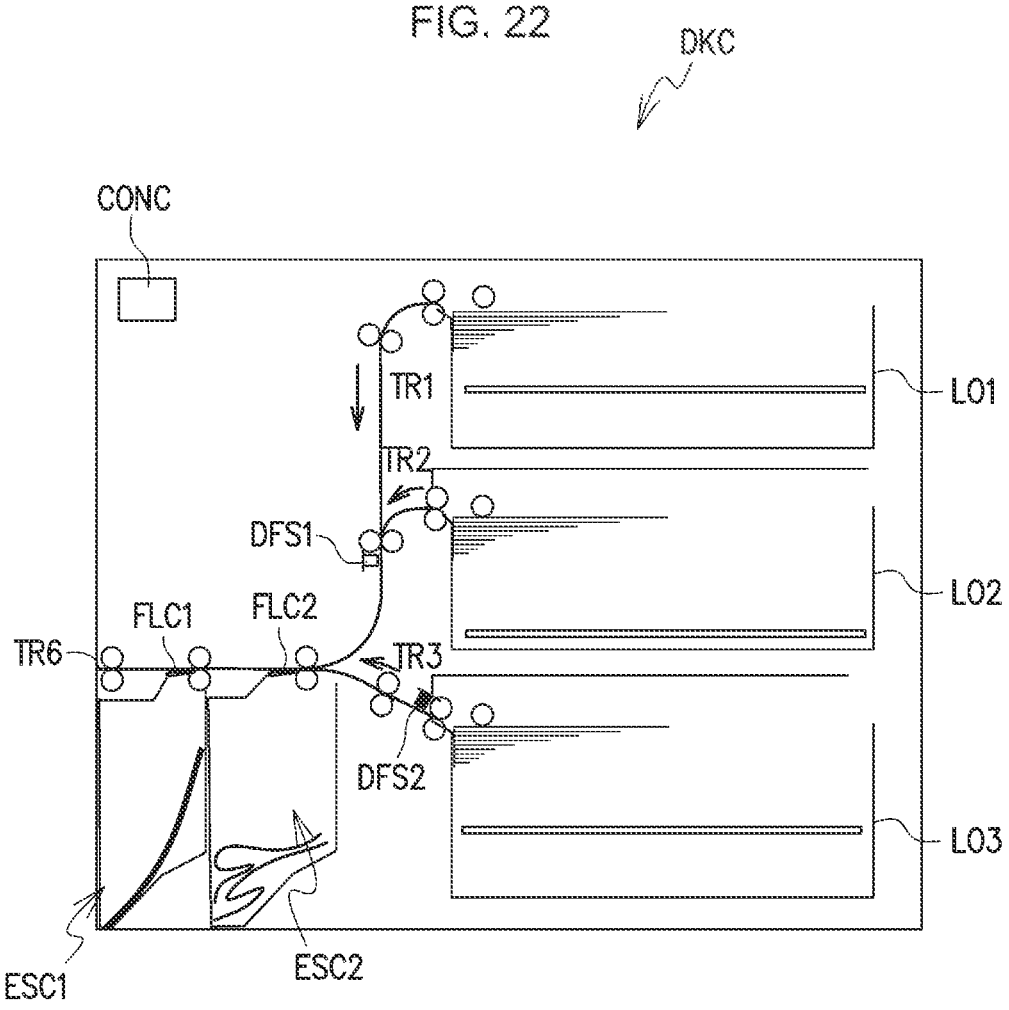
FIG. 22 is a state view illustrating sixth multi feed processing in Embodiment 5 of the sheet feeding apparatus according to the present invention.
Figure 23:
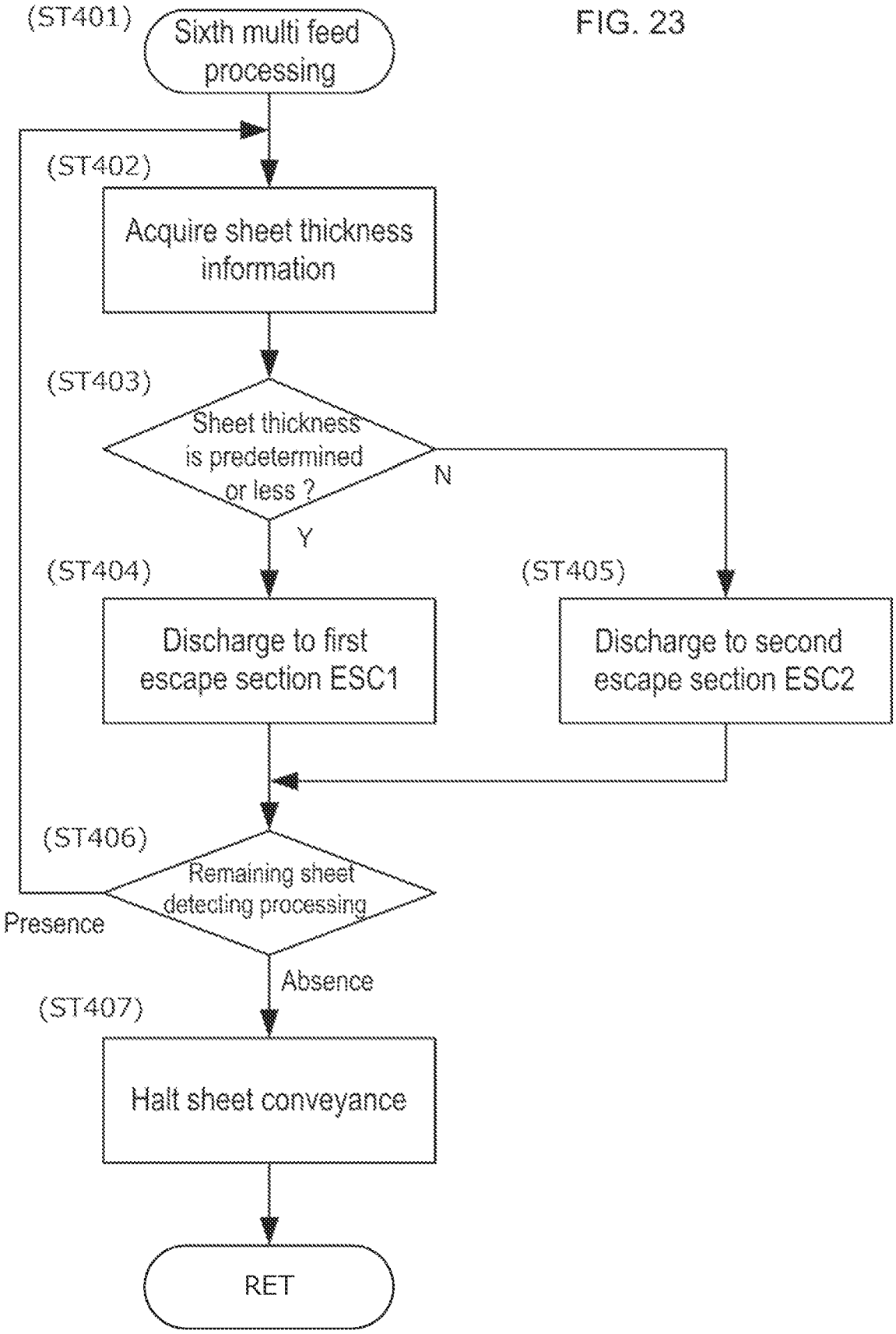
FIG. 23 is a flowchart diagram illustrating the sixth multi feed processing in Embodiment 5 of the sheet feeding apparatus according to the present invention.

FIG. 22 is a view illustrating a configuration of a sheet feeding apparatus DKC to which Embodiment 5 is applicable, and FIG. 23 illustrates a multi feed processing flow. In Embodiment 5, a control section CONC controls to discharge sheets with a predetermined thickness or less to one of first and second escape sections ESC1, ESC2, and discharge thick sheets thicker than the predetermined thickness to the other escape section. Herein, it is assumed that multi-fed sheets and remaining sheets with thicknesses as a general normal sheet are discharged to the first escape section ESC1, and that multi-fed sheets and remaining sheets formed of thick sheets thicker than the normal sheet are discharged to the second escape section ESC2. The sheet feeding apparatus DKC of Embodiment 5 is a modification of the sheet feeding apparatus DKC of Embodiment 4, and by making the capacity of the second escape section ESC2 larger than the first escape section ESC1, enhances the sheet discharge capability.

When the control section CONC detects multi-fed sheets passing the conveyance paths TR1, TR2 using the multi feed sensor DFS1, or multi-fed sheets passing the conveyance path TR3 using the multi feed sensor DFS2, the control section acquires thickness information of the multi-fed sheets (ST402), and makes a thickness determination (ST403). Herein, when it is determined that the multi-fed sheets are a predetermined thickness or less, a flapper FLC1 is switched toward the first escape ESC1, and the multi-fed sheets with the predetermined thickness or less are thereby discharged to the first escape section ESC1 (ST404). On the other hand, when it is determined that the detected multi-fed sheets are thicker than the predetermined thickness, a flapper FLC2 is switched toward the second escape ESC2, and the thick multi-fed sheets thicker than the predetermined thickness are thereby discharged to the second escape section ESC2 (ST405).

In processing for detecting a remaining sheet (ST406), after finishing discharge of multi-fed sheets to the first or second escape section ESC1, ESC2 by sheet thickness determination processing (ST403), it is detected whether or not a remaining sheet exists. As a result, in the case where the remaining sheet exists, processing for the remaining sheet is started (ST401), and in the case where any remaining sheet does not exist, sheet conveyance is halted (ST407).

In the above-mentioned Embodiments 1 to 5, each Embodiment is configured to provide a plurality of escape sections, select one of the plurality of escape sections corresponding to conditions such as a position and type (size, thickness) of multi-fed sheets and remaining sheet, and the storage state of sheets in the escape section, and discharge the multi-fed sheets and remaining sheet. By this means, it is possible to decrease the halt of the apparatus executed due to the full state of the escape section, and the frequency of sheet removal operation accompanied by the halt of the apparatus. Further, by decreasing the halt of the apparatus and the frequency of sheet removal operation, it is also possible to reduce the effect on productivity of sheets to a minimum.

The present application claims priority based on Japanese Patent Application No. 2020-214560 and Japanese Patent Application No. 2020-214562 filed on Dec. 24, 2020, and Japanese Patent Application No. 2021-029481 filed on Feb. 26, 2021, and entire described contents described in the Japanese Patent Applications are expressly incorporated by reference herein.

The invention claimed is:

1. A sheet feeding apparatus for feeding sheets, comprising:

a stack section adapted to stack sheets;

a sheet feeding section adapted to feed a sheet in the stack section;

a conveyance path adapted to guide the sheet fed from the sheet feeding section to a downstream direction;

a conveying section adapted to convey the sheet along the conveyance path;

a multi feed detecting section adapted to detect multi feed of sheets conveyed by the conveying section, in a predetermined detection position of the conveyance path;

first and second discharge sections to which multi-fed sheets with the multi feed detected are discharged;

a sheet front end position detecting section adapted to identify a front end position of the multi-fed sheets at a time the multi feed detecting section detects the multi feed of sheets; and a control section adapted to control the conveying section, wherein based on the position of the front end of the multi-fed sheets identified by the sheet front end position detecting section, the control section selects one of the first and second discharge sections to convey the multi-fed sheets to the selected discharge section, and the control section discharges, to the second discharge section, a remaining sheet existing inside the conveyance path upstream of the multi-fed sheets at a time the multi feed detecting section detects the multi feed of sheets.

2. The sheet feeding apparatus according to claim 1, further comprising:

a first guide member adapted to guide the multi-fed sheets from a first position provided downstream of a detection position of the conveyance path to the first discharge section; and a second guide member adapted to guide the multi-fed sheets from a second position between a multi feed detection position of the multi feed detecting section and the first position of the conveyance path to the second discharge section, wherein the control section controls the first guide member and the second guide member so as to guide the multi-fed sheets to the second discharge section by the second guide member when the position of the front end of the multi-fed sheets identified by the sheet front end position detecting section is upstream from the second position, while guiding the sheets to the first discharge section by the first guide member when the position of the front end of the multi-fed sheets is downstream from the second position of the conveyance path.

3. The sheet feeding apparatus according to claim 1, wherein the apparatus is comprised of a first sheet feeding unit provided with the first discharge section, and a second sheet feeding unit provided with the stack section, the sheet feeding section, the multi feed detecting section, the second discharge section, and the sheet front end position detecting section to supply the sheets of the stack section.

4. A sheet feeding apparatus for feeding sheets, comprising:

a stack section adapted to stack sheets;

a sheet feeding section adapted to feed a sheet in the stack section;

a conveyance path adapted to guide the sheet fed from the sheet feeding section to a downstream direction;

a conveying section adapted to convey the sheet along the conveyance path;

a multi feed detecting section adapted to detect multi feed of sheets conveyed by the conveying section, in a predetermined detection position of the conveyance path;

first and second discharge sections to which multi-fed sheets with the multi feed detected by the multi feed detecting section are discharged;

a first full detecting section adapted to detect whether or not the second discharge section is full of sheets;

a control section adapted to control the conveying section;

a first guide member adapted to guide the multi-fed sheets from a first position provided downstream of a detection position of the conveyance path to the first discharge section; and a second guide member adapted to guide the multi-fed sheets from a second position between a multi feed detection position of the multi feed detecting section and the first position of the conveyance path to the second discharge section, wherein based on a detection result of the first full detecting section, the control section selects one of the first and second discharge sections to convey the multi-fed sheets to the selected discharge section, the control section controls the first guide member and the second guide member so as to guide the multi-fed sheets to the second discharge section by the second guide member when the first full detecting section does not detect that the second discharge section is full, while guiding the multi-fed sheets to the first discharge section by the first guide member in detecting that the second discharge section is full, and the control section controls the first guide member and the second guide member so as to guide a remaining sheet, left upstream of the multi-fed sheets at a time the multi feed detecting section detects the multi feed of sheets, to the second discharge section by the second guide member, when the first full detecting section does not detect that the second discharge section is full, while guiding the remaining sheet to the first discharge section by the first guide member in detecting that the second discharge section is full.

5. The sheet feeding apparatus according to claim 4, further comprising:

a second full detecting section adapted to detect whether or not the first discharge section is full of sheets, wherein when the first full detecting section detects the full and the second full detecting section detects the full, the control section halts conveyance of the multi-fed sheets or the remaining sheet.

6. The sheet feeding apparatus according to claim 4, wherein the apparatus is comprised of a first sheet feeding unit provided with the first discharge section, and a second sheet feeding unit provided with the stack section, the sheet feeding section, the multi feed detecting section, the first full detecting section and the second discharge section to supply the sheets of the stack section.

7. A sheet feeding apparatus for feeding sheets, comprising:

a stack section adapted to stack sheets;

a sheet feeding section adapted to feed a sheet in the stack section;

a conveyance path adapted to guide the sheet fed from the sheet feeding section to a downstream direction;

a conveying section adapted to convey the sheet along the conveyance path;

a multi feed detecting section adapted to detect multi feed of sheets conveyed by the conveying section, in a predetermined detection position of the conveyance path;

first and second discharge sections to which multi-fed sheets with the multi feed detected by the multi feed detecting section are discharged;

a control section adapted to select one of the first and second discharge sections corresponding to a predetermined condition and to convey the multi-fed sheets detected by the multi feed detecting section to a selected discharge section;

a first storage amount detecting section adapted to detect a storage amount of sheets inside the first discharge section; and a second storage amount detecting section adapted to detect a storage amount of sheets inside the second discharge section, wherein the predetermined condition is the storage amount of sheets inside the first discharge section and the storage amount of sheets inside the second discharge section, and the control section makes a comparison between the storage amount of sheets detected by the first storage amount detecting section and the storage amount of sheets detected by the second storage amount detecting section, and based on a result of a comparison, selects one of the first and second discharge sections to discharge the multi-fed sheets to a selected discharge section.

8. The sheet feeding apparatus according to claim 7, wherein as a result of comparing between the storage amount of sheets detected by the first storage amount detecting section and the storage amount of sheets detected by the second storage amount detecting section, the control section selects the second discharge section when the storage amount of sheets inside the first discharge section is the storage amount of sheets inside the second discharge section or more, while selecting the first discharge section when the storage amount of sheets inside the first discharge section is smaller than the storage amount of sheets inside the second discharge section.

* * * * *